US005596645A

United States Patent [19]

Fujimori

[11] Patent Number: 5,596,645

[45] Date of Patent: Jan. 21, 1997

[54] SOUND IMAGE LOCALIZATION CONTROL DEVICE FOR CONTROLLING SOUND IMAGE LOCALIZATION OF PLURAL SOUNDS INDEPENDENTLY OF EACH OTHER

[75] Inventor: Junichi Fujimori, Hamamatsu, Japan

[73] Assignee: Yamaha Corporation, Hamamatsu, Japan

[21] Appl. No.: 413,347

[22] Filed: Mar. 30, 1995

[30] Foreign Application Priority Data

Mar. 30, 1994 [JP] Japan ..... 6-082663

[51] Int. Cl.[6] ..... H04R 5/00

[52] U.S. Cl. ..... 381/17; 381/61; 381/102; 381/97

[58] Field of Search ..... 381/1, 17, 61, 381/62, 63, 97, 101, 102

[56] References Cited

U.S. PATENT DOCUMENTS 4,792,974 12/1988 Chace ..... 381/17

*Primary Examiner*—Curtis Kuntz
*Assistant Examiner*—Minson Oh
*Attorney, Agent, or Firm*—Loeb & Loeb LLP

[57] ABSTRACT

Processing systems corresponding to the right and left channels are provided for applying independent sound image localization control to each of plural input sound signals on the basis of at least individual amplitude coefficients and delay information for the right and left channels that are separately provided for each of the input sound signals. The same sound signals are distributively input to each of the processing systems. Each of the processing systems comprises a delay line providing plural delay stages, a coefficient operator for arithmetically operating each of the input sound signals with the individual amplitude coefficient separately provided therefor, and an input circuit for additively inputting the sound signals, having been arithmetically operated by the coefficient operator, to the delay line at the respective delay stages corresponding to the individual delay information, so that the sound signals input to the respective delay stages are gradually mixed together while being sequentially delayed, so as to ultimately output a single sound signal that is a mixture of the plural sound signals arithmetically operated with the amplitude coefficients. Further, with respect to one of the input sound signals, two operation units each including a coefficient operator and an input circuit are assigned as the right channel operation units, and similar two operation units are assigned as the left channel operation units. Also, time-variation of sound image localization can be achieved.

17 Claims, 12 Drawing Sheets

SOUND IMAGE LOCALIZATION CONTROL DEVICE FOR CONTROLLING SOUND IMAGE LOCALIZATION OF PLURAL SOUNDS INDEPENDENTLY OF EACH OTHER

BACKGROUND OF THE INVENTION

The present invention relates to a sound image localization control device for imparting sound image localization to each of plural sound signals supplied from different sound sources.

It is generally known that by controlling the sound pressure levels of sounds output from speakers of two or more channels, sound image localization in the sound field can be controlled in a desired manner. Where sound image localization is to be controlled by controlling the sound pressure levels, sound image localization control devices are used which cause the sound pressure levels of the respective outputs from right and left speakers to differ from each other while maintaining the total acoustic output at a constant level, to thereby allow the sound image to be localized at a position closer to the speaker of greater sound pressure level. A so-called "stereo pan pot" is used to maintain the total acoustic output at a constant level. Namely, the stereo pan pot controls the right and left sound pressure levels in such a manner that the total acoustic output is maintained at a constant level even when the sound image is panned to an arbitrary position within the sound field.

The conventional sound image localization control devices also operate to cause sounds output from the right and left speakers to reach the listener's right and left ears at slightly different time points by delaying the sound signal by predetermined time via delay circuitry, so as to allow the sound image to be localized at a position closer to one of the speakers whose output sound reaches the ear earlier than the other speaker.

FIG. 14 is a block diagram showing the general structure of a typical prior sound image localization control device employing delay circuitry. This prior art sound image localization control device is designed to impart independent sound image localization to each of sound signals input from three sound source A, B and C. More specifically, the sound image localization control device is comprised of six delay circuits D1 to D6, six multipliers M1 to M6, and six adders A1 to A6.

Delay circuits D1 and D2 process the sound signal from the sound source circuit A to cause the sound wave to reach the right and left ears of the listener with a slight time difference (this time difference will hereinafter be called an "ear-reaching time difference"). Likewise, the delay circuits D3 and D4 serve to impart such an ear-reaching time difference to the sound signal from the sound source circuit B. Further, the delay circuits D5 and D6 serve to impart such an ear-reaching time difference to the sound signal from the sound source circuit C. The multipliers M1 and M2 process the sound signal from the sound source circuit A to cause the sound wave to reach the right and left ears of the listener with a slight level difference (this level difference will hereinafter be called an "ear-reaching level difference". Likewise, the multipliers M3 and M4 serve to impart such an ear-reaching level difference to the sound signal from the sound source circuit B. Further, the multipliers M5 and M6 serve to impart such an ear-reaching level difference to the sound signal from the sound source circuit C.

The delay circuits D1, D3 and D5, multipliers M1, M3 and M5 and adders A1, A3 and A5 together generate sound for the left (L) channel, while the delay circuits D2, D4 and D6 and multipliers M2, M4 and M6, and adders A2, A4 and A6 together generate sound for the right (R) channel.

The delay circuit D1 delays the signal from the sound source circuit A by predetermined time DAL and outputs the resultant delayed signal to the multiplier M1. The multiplier M1 multiplies the signal, delayed by the delay circuit D1, by a predetermined coefficient LAL and outputs the multiplication result to the adder A1. The adder A1 adds the output signal from the multiplier M1 to an initial value "0", and outputs the addition result to the next-stage adder A3. Namely, the adder A1 provides the output signal from the multiplier M1 directly to the adder A3 and hence may be omitted. The delay circuit D3 delays the signal from the sound source circuit B by predetermined time DBL and outputs the resultant delayed signal to the multiplier M3. The multiplier M3 multiplies the signal, delayed by the delay circuit D3, by a predetermined coefficient LBL and outputs the multiplication result to the adder A3. The adder A3 adds together the output signals from the adder A1 and multiplier M3 and outputs the addition result to the next-stage adder A5. The delay circuit D5 delays the signal from the sound source circuit C by predetermined time DCL and outputs the resultant delayed signal to the multiplier M5. The multiplier M5 multiplies the signal, delayed by the delay circuit D5, by a predetermined coefficient LCL and outputs the multiplication result to the adder BAS. The adder A5 adds together the output signals from the adder A3 and multiplier M5 and outputs the addition result as sound for the left channel.

The delay circuit D2 delays the signal from the sound source circuit A by predetermined time DAR and outputs the resultant delayed signal to the multiplier M2. The multiplier M2 multiplies the signal, delayed by the delay circuit D2, by a predetermined coefficient LAR and outputs the multiplication result to the adder A2. The adder A2 adds the output signal from the multiplier M2 to an initial value "0", and outputs the addition result to the next-stage adder A4. The delay circuit D4 delays the signal from the sound source circuit B by predetermined time DBR and outputs the resultant delayed signal to the multiplier M4. The multiplier M4 multiplies the signal, delayed by the delay circuit D4, by a predetermined coefficient LBR and outputs the multiplication result to the adder A4. The adder A4 adds together the output signals from the adder A2 and multiplier M4 and outputs the addition result to the next-stage adder A6. The delay circuit D6 delays the signal from the sound source circuit C by predetermined time DCR and outputs the resultant delayed signal to the multiplier M6. The multiplier M6 multiplies the signal, delayed by the delay circuit D6, by a predetermined coefficient LCR and outputs the multiplication result to the adder A6. The adder A6 adds together the output signals from the adder A4 and multiplier M6 and outputs the addition result as sound for the right channel.

Here, the ear-reaching time difference is the absolute value of the difference |DAL–DAR|, |DBL–DBR| or |DCL–DCR| between the delay times of the delay circuits D1 and D2, D3 and D4, or D5 and D6 corresponding to the sound source circuit A, B or C. The maximum ear-reaching time difference is obtained by dividing the distance between the ears by the speed of sound; if the distance between the ears is about 17 cm, the maximum ear-reaching time difference will be 0.5 ms (=17/33000). If, for example, the sampling frequency of the sound image localization control device shown in FIG. 14 is 50 kHz, the delay time corresponding to one sampling period will be 0.02 ms, and hence each of the delay circuit D1 to D6 is comprised of about 25 delay stages in order to smoothly time-vary sound image localization and achieve the maximum delay time of 0.25 ms.

With the prior art, in order to provide the feeling of independent sound image localization for each of plural (N) sound sources, the two-channel (right- and left-channel) reproduction system requires at least 2N delay circuits, each of which has to be comprised of memory corresponding to at least 25 stages. Consequently, there is encountered the problem that the memory capacity necessary for the delay circuits has to greatly increase as the number of sound sources increases.

SUMMARY OF THE INVENTION

It is therefore an object of the present invention to provide an sound image localization control device which achieves predetermined delay time without compromising the effect of sound image localization even in the case where separate delay circuit is not provided for each of plural sound sources.

It is another object of the present invention to provide an sound image localization control device which permits efficient use of an arithmetic operation device for sound image localization control.

In order to accomplish the above-mentioned objects, the present invention provides a sound image localization control device for applying independent sound image localization control to each of plural input sound signals on the basis of at least individual amplitude coefficients and delay information for right and left channels that are separately provided for each of the input sound signals, the sound image localization control device comprising at least two processing systems corresponding to the right and left channels, the same sound signals being distributively input to each of the processing systems, each of the processing systems comprising a delay section providing plural delay stages, a coefficient operation section for arithmetically operating each of the input sound signals with the individual amplitude coefficient separately provided therefor, and an input section for additively inputting the sound signals, having been arithmetically operated with the individual amplitude coefficients, to the delay section at the respective delay stages corresponding to the individual delay information, whereby the sound signals input to the respective delay stages are gradually mixed together while being sequentially delayed, so as to ultimately output a single sound signal that is a mixture of the plural sound signals arithmetically operated with the amplitude coefficients.

To first describe the processing system for the right channel, only one delay section is sufficient even in such a case where there are input plural sound signals each of which has to be subjected to independent sound image localization control. If one (first) input sound signal arithmetically operated with the individual amplitude coefficient separately provided therefor is input at one (first) delay stage and another (second) input sound signal arithmetically operated with the individual amplitude coefficient separately provided therefor is input at another (second) delay stage succeeding the first delay stage, the first sound signal is added to the second sound signal at the second delay stage so that the first sound is sequentially delayed along the same delay line. Thus, a single sound signal which is a mixture of all the sound signals arithmetically operated with the corresponding amplitude coefficients is ultimately output from the delay section. The processing system for the left channel operates in a similar manner to the right channel processing system. Consequently, it is allowed to eliminate the need to provide a separate delay section for each sound signal to which independent sound image localization control has to be applied, and hence the construction of the device can be greatly simplified. Of course, because each sound signal is input at an individual delay stage, the delay time for the signal will be set by the individual delay information.

The delay section may be implemented by a shift-register-type delay circuit which achieves time delay by actually sequentially shifting sound signal data. Alternatively, the delay section may be implemented by a ring-buffer-type delay circuit which includes a data memory for storing digital sound signal sample data, and a read/write control section for controlling data write/read to and from the data memory so as to allow the sound signal sample data, written at specific time at a specific address, to be read out from said specific address with a delay corresponding to a selected number of said delay stages so as to impart a desired time delay.

A sound image localization control device according to one embodiment mode of the present invention includes an interpolation section for distributing the sound signal, having been arithmetically operated by the coefficient operation section, to at least two interpolation operation channels so as to multiply the distributed sound signals by respective predetermined interpolation coefficients, and for causing the sound signals multiplied by the predetermined interpolation coefficients to be additively input to different delay stages of the delay section, whereby a delay shorter than that provided by one delay stage is achieved. According to another mode of embodiment, the predetermined interpolation coefficients are time-varied so as to achieve a smooth time-variation in the delay shorter than that provided by one delay stage. Further, timewise movement of sound image localization may be achieved by time-varying the interpolation coefficient to perform a cross-fade interpolation.

The operation section for arithmetically operating with the amplitude coefficient, and the operation and control section for reading/writing data at a desired delay stage and adding the read-out data can be implemented in efficient form using a digital signal processor. To this end, the sound image localization control device of the invention, which applies independent sound image localization control to each of plural input sound signals on the basis of at least individual amplitude coefficients and delay information for right and left channels that are separately provided for each of the sound signals, comprises a first delay line for the right channel providing plural delay stages, a second delay line for the left channel providing plural delay stages, a processing section including plural operation units each including a coefficient operation section for arithmetically operating one of the input sound signals with the amplitude coefficient, and an input section for accessing one of the delay lines and additively inputting output sound signal of the coefficient operation section to the one delay line at a specific delay stage corresponding to the delay information, and an assignment section for, with respect to each of the input sound signals, assigning two of the operation units of the processing section as right and left channel operation units, respectively, the assignment section providing the amplitude coefficient and delay information for the right channel to the operation unit assigned as the right channel operation unit and causing the right channel operation unit to access the first delay line, and providing the amplitude coefficient and delay information for the left channel to the operation unit assigned as the left channel operation unit and causing the left channel operation unit to access the second delay line.

In one preferred mode of embodiment of the invention, with respect to one input sound signal, the first and second delay lines may be advantageously implemented using a data memory. In another mode of embodiment, two more operation units of the processing section may be additionally assigned as the right and left channel operation units, respectively, and as the result, with respect to the one input sound signal, two operation units may be assigned for each of the right and left channels. By performing a cross-fade interpolation operation using the two operation units for each of the right and left channels, it is possible to achieve timewise movement of sound image localization. In another mode of embodiment, the additional operation units provided for the cross-fade interpolation operation may be selectively assigned only when the sound image localization is to be moved so as to permit efficient use of the operation units.

Now, the preferred embodiments of the present invention will be described in detail below with reference to the accompanying drawings.

DETAILED DESCRIPTION OF THE PREFERRED EMBODIMENTS

Figure 2:
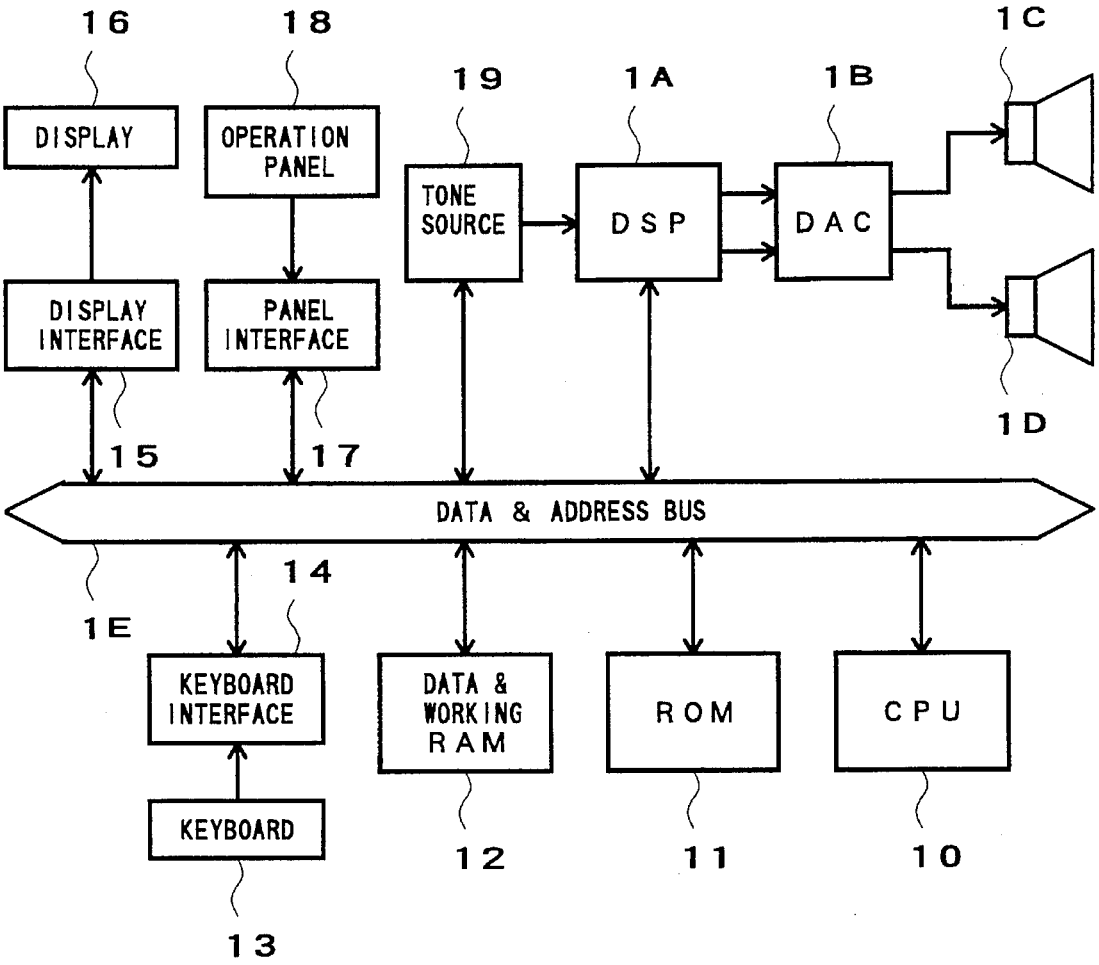
FIG. 2 is a block diagram showing the general structure of an electronic musical instrument containing the sound image localization control device of the present invention.

FIG. 2 is a block diagram showing the general structure of an electronic musical instrument containing a sound image localization control device of the present invention.

The electronic musical instrument to which the present invention is applied may be any type of electronic musical instrument, such as an electronic organ, electronic piano, electronic rhythm instrument, electronic wind instrument, electronic stringed instrument or electronic percussion instrument, which is designed to generate tone of a corresponding natural musical instrument. A description will be made below in relation to an electronic keyboard instrument where the pitch of tone to be generated is designated by a keyboard.

In this embodiment, control of the entire electronic musical instrument is performed by a microcomputer that is comprised of microprocessor unit (CPU) 10, ROM 11 and data and working RAM 12.

The CPU 10 controls the overall operation of the musical instrument. To this CPU 10 are connected, via a data and address bus IE, the ROM 11, data and working RAM 12, keyboard interface 14, display interface 15, panel interface 17, tone source 19 and localization control circuit 1A.

The ROM 11 is a read-only memory provided for storing system program for the CPU 10, various tone-related parameters, a plurality of microprogram to be set in the localization control circuit 1A as well as a variety of data.

The data and working RAM 12 temporarily stores various other data occurring as the CPU 10 executes the program, and is provided in predetermined address regions of a random access memory (RAM) for use as registers and flags.

Keyboard 13 is provided with a plurality of keys for designating the pitch of tone to be generated and includes key switches corresponding to the individual keys. If necessary, the keyboard 13 may also include a touch detection means such as a key depressing force detection device. Although described here as employing the keyboard 13 that is a fundamental performance operator relatively easy to understand, the embodiment may of course employ any performance operator other than the keyboard.

The keyboard interface 14 includes key switch circuits that are provided in corresponding relations to the pitch designating keys of the keyboard 13. This keyboard interface 14, upon its detection of a change from the released state to the depressed state of a key, outputs key-on event information containing the key code of the depressed key, and, upon its detection of a change from the depressed state to the released state of a key, outputs key-off event information containing the key code of the released key. At the same time, the keyboard interface 14 also determines the depression velocity or force of the depressed key so as to generate touch data and output the thus-generated touch data as velocity data.

The display interface 15 drives a display section 16 so as to display various information such as the control states of the electronic musical instrument, contents of currently-set parameters and parameters settable in the electronic musical instrument.

The display section 16 is comprised of a liquid crystal display panel (LCD), light emitting diodes (LEDs), etc., and the operation of the display section 16 is controlled by the display interface 15.

The panel interface 17 scans various switches provided on an operation panel 18 to detect the operational states (kinds of events) of the switches and outputs the event information as an interrupt signal to the CPU 10 via the data and address bus 1E.

The operation panel 18 includes various operators for selecting, setting and controlling the tone color, envelope, effect information etc., among which are localization designating switches for designating sound image localization of tone signals generated by respective tone source circuits of the tone source 19.

The tone source 19 is comprised of a plurality of tone source circuits capable of simultaneously generating tone signals through plural (n) tone generation channels. This embodiment will be described on the assumption that the tone source 19 is comprised of three tone source circuits A, B and C, each of which receives performance information (key code, key-on signal, touch data, various parameters etc.) that is supplied to each tone generation channel via the data and address bus 18 and, on the basis of the performance information received, generates tone signal of predetermined tone color by use of a predetermined tone signal generation system.

Each of the tone source circuits may employ any of the conventionally-known tone signal generation systems such as: the memory readout system where tone waveform sample value data stored in a waveform memory are sequentially read out by address data changing in correspondence to the pitch of tone to be generated; the FM system where tone waveform sample value data are obtained by performing predetermined frequency modulation operations using the address data as phase angle parameter data; the AM system where tone waveform sample value data are obtained by performing predetermined amplitude modulation operations using the address data as phase angle parameter data; and the overtone addition system using tone generation algorithms.

The plural-channel tone signals generated by the tone source 19 (tone signals output from the tone source circuits A, B and C) are audibly reproduced or sounded via the localization control circuit 1A, digital-to-analog converter (DAC) 1B and amplifiers and speakers of sound systems 1C and 1D.

The localization control circuit 1A performs localization control on the three-channel tone signals fed from the tone source 19 to output the localization-controlled tone signals to the DAC 1B, and performs different arithmetic operations on the three-channel tone signals so as to impart different effects to the tone signals. This localization control circuit will be described later in greater detail.

The digital-to-analog converter 1B converts into analog form the digital, localization-controlled and effect-imparted tone signals, and outputs the converted tone signals to the external sound systems 1C and 1D.

Each of the sound systems 1C and 1D is comprised of the amplifier and speaker, which generate tone corresponding to the analog signal output from the DAC 1B. Consequently, the tones generated from the two speakers of the sound systems 1C and 1D will present predetermined sound image localization.

Now, the detailed structure of the localization control circuit 1A will be explained with reference to FIG. 1 which shows in block diagram the structure of the localization control circuit 1A of FIG. 2.

As shown, the localization control circuit 1A is arranged so as to provide sound image localization to the tone signals from the three tone source circuits A, B and C independently of each other. To this end, the localization control circuit 1A includes six multipliers M1 to M6, five delay circuits D13, D35, D50, D24 and D60, and six adders A1 to A6.

The multipliers M1, M3 and M5, delay circuits D13, D35 and D50 and adders A1, A3 and A5 cooperate to generate tone for the left (L) channel, while the multipliers M2, M4 and M6, delay circuits D24 and D60 and adders A2, A4 and A6 cooperate to generate tone for the right (R) channel.

The multiplier M1 multiplies the tone signal from the tone source circuit A by a predetermined coefficient LAL and outputs the multiplication result to the adder A1. The adder A1 adds the output signal from the multiplier M1 to an initial value "0", and outputs the addition result to the delay circuit D13. In an alternative arrangement, the adder A1 may be omitted, and in such a case the signal from the multiplier M1 may be provided directly to the delay circuit D13. The delay circuit D13 delays the signal from the adder A1 by predetermined time DLA and outputs the resultant delayed signal to the next-stage adder A3. The multiplier M3 multiplies the tone signal from the tone source circuit B by a predetermined coefficient LBL and outputs the multiplication result to the adder A3. The adder A3 adds together the signals from the multiplier M3 and delay circuit D13 and outputs the addition result to the next-stage delay circuit D35. The delay circuit D35 delays the signal from the adder A3 by predetermined time DLB and outputs the resultant delayed signal to the next-stage adder A5. The multiplier M5 multiplies the tone signal from the tone source circuit C by a predetermined coefficient LCL and outputs the multiplication result to the adder A5. The adder A5 adds together the signals from the multiplier M5 and delay circuit D50 and outputs the addition result to the next-stage delay circuit D50. The delay circuit D50 delays the signal from the adder A5 by predetermined time DLC and outputs the resultant delayed signal as a final tone signal for the left channel.

The multiplier M2 multiplies the tone signal from the tone source circuit A by a predetermined coefficient LAR and outputs the multiplication result to the adder A2. The adder A2 adds the output signal from the multiplier M2 to an initial value "0", and outputs the addition result to the delay circuit D24. In an alternative arrangement, the adder A2 may be omitted, and in such a case the signal from the multiplier M2 may be provided directly to the delay circuit D24. The delay circuit D24 delays the signal from the adder A2 by predetermined time DRA and outputs the resultant delayed signal to the next-stage adder A4. The multiplier M4 multiplies the tone signal from the tone source circuit B by a predetermined coefficient LBR and outputs the multiplication result to the adder A4. The adder A4 adds together the signals from the multiplier M4 and delay circuit D24 and outputs the addition result to the next-stage adder A6. The multiplier M6 multiplies the tone signal from the tone source circuit C by a predetermined coefficient LCR and outputs the multiplication result to the adder A6. The adder A6 adds together the signals from the multiplier M4 and multiplier M6 and outputs the addition result to the next-stage delay circuit D60. The delay circuit D60 delays the signal from the adder A6 by predetermined delay time DRC and outputs the resultant delayed signal as a final tone signal for the right channel.

The delay circuits D13, D35, D50, D24 and D60 serve to impart the tone signal from the tone source circuit A a time difference that allows the sound wave to reach the right and left ears of the listener at slightly different time points (this time difference will hereinafter be called an "ear-reaching time difference"). The delay circuits D35, D50 and D60 serve to impart such an ear-reaching time difference to the tone signal from the tone source circuit B. Likewise, the delay circuits D50 and D60 serve to impart such an ear-reaching time difference to the tone signal from the tone source circuit C. The multiplier M1 and M2 serve to impart the tone signal from the tone source circuit A a level difference that allows the sound wave to reach the right and left ears of the listener with slightly different levels (this level difference will hereinafter be called an "ear-reaching level difference". The multiplier M3 and M4 serve to impart such an ear-reaching level difference to the tone signal from the tone source circuit B. Likewise, the multiplier M5 and M6 serve to impart such an ear-reaching level difference to the tone signal from the tone source circuit C.

In order for the localization control circuit 1A to perform the same localization control as in the prior art sound image localization control circuit of FIG. 14, it is only sufficient that the delay times DLA, DLB, DLC, DRA and DRC of the individual delay circuits D13, D35, D50, D24 and D60 be set in the following manner.

Figure 1:
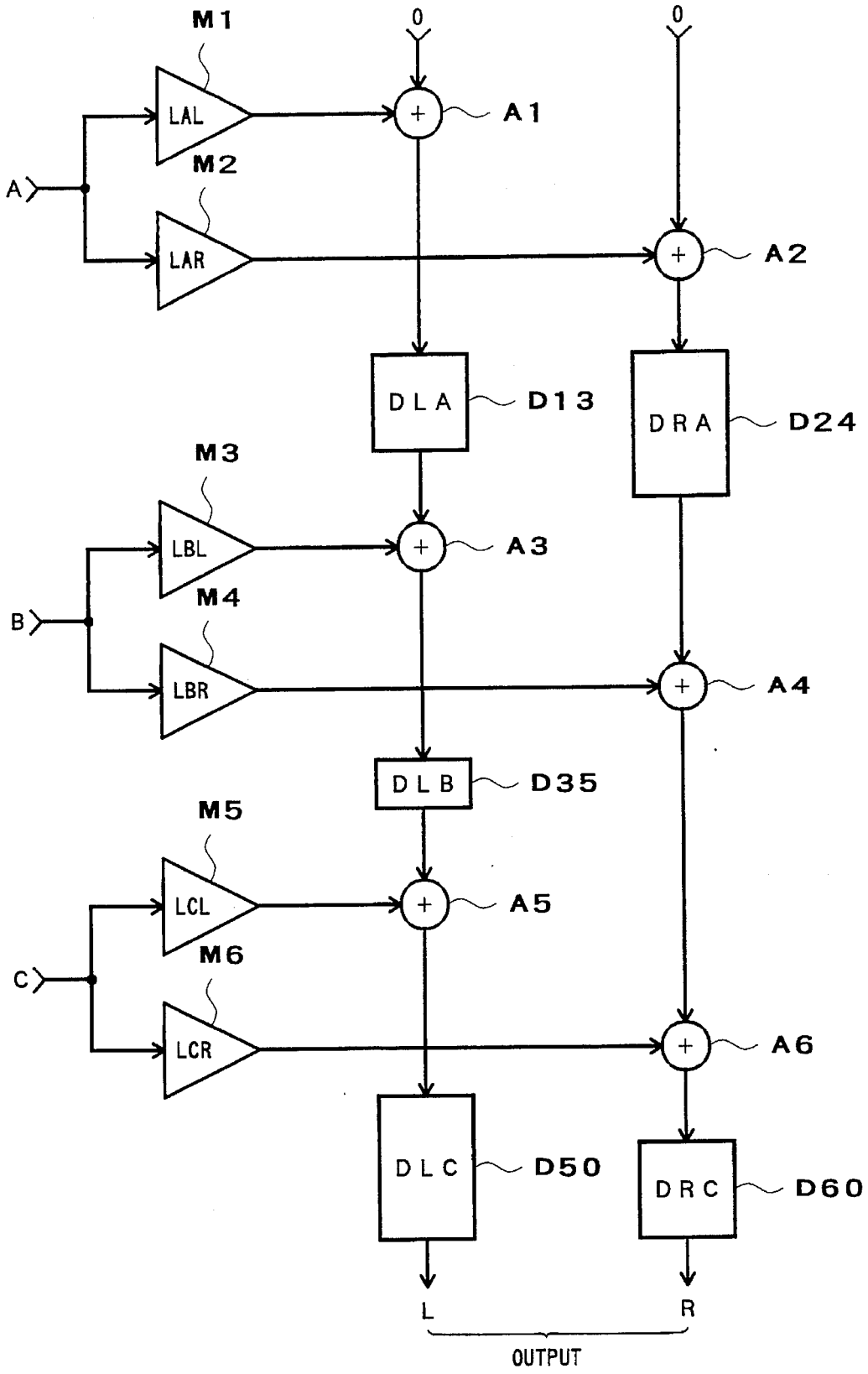
FIG. 1 is a block diagram illustrating the structure of a localization control device in accordance with an embodiment of the present invention.
Figure 14:
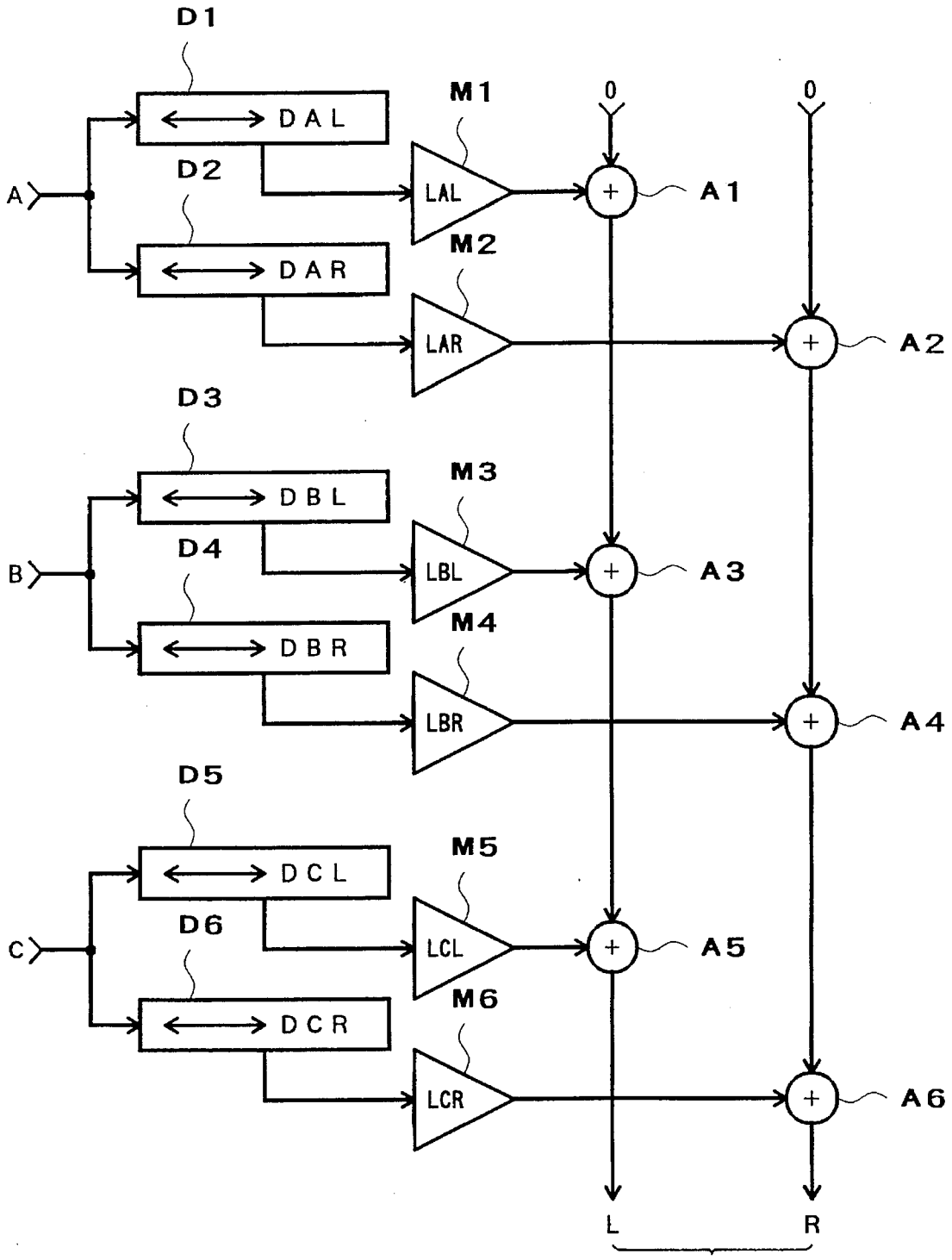
(PRIOR ART) FIG. 14
FIG. 14 iS a block diagram showing the general structure of a prior art sound image localization control device which employs delay circuits.

Namely, because the tone signal supplied from the tone source circuit A and output via the left channel passes through the delay circuits D13, D35 and D50 in the illustrated example of FIG. 1, the total delay time DLA+DLB+DLC of these delay circuits D13, D35 and D50 is set to be identical to the delay time of the delay circuit D1 of FIG. 14. Because the tone signal supplied from the tone source circuit A and output via the right channel passes through the delay circuits D24 and D60 in the illustrated example of FIG. 1, the total delay time DRA+DRC of these delay circuits D24 and D60 is set to be identical to the delay time of the delay circuit D2 of FIG. 14.

Similarly, the total delay times DLB+DLC, DRC, DLC and DRC in the localization control circuit 1A are set to be identical to the delay times DBL, DBR, DCL and DCR, respectively, of the delay circuits D3, D4, D5 and D6 in the sound image localization control circuit of FIG. 14.

The above-mentioned relationships may be expressed in the following equations:

$$DAL=DLA+DLB+DLC$$

$$DAR=DRA+DRC$$

$$DBL=DLB+DLC$$

$$DBR=DRC$$

$$DCL=DLC$$

$$DCR=DRC$$

In these equations, it is sufficient that both the delay times DLA+DLB+DLC and DRA+DR be smaller that the maximum value of the ear-reaching time difference. For example, in this embodiment, the maximum value of the ear-reaching time difference may be about 0.5 ms which is obtained by dividing the ear-to-ear distance (for example, about 17 cm) of the listener by the speed of sound (for example, 330 m/s).

In the illustrated example of FIG. 1, if the sampling frequency of the localization control circuit is 50 kHz, the possible delay time of each delay circuit D13, D35, D50, D24 and D60 is an integer multiple of the delay time corresponding to one sampling period (0.02 ms), depending on the number of memory stages constituting that delay circuit. That is, the possible delay time of each delay circuit constituting the localization control circuit of FIG. 1 is of value obtained by multiplying the number of memory stages in that delay circuit by the delay time corresponding to one sampling period, and it is difficult to control the delay time more smoothly than that. Thus, the localization control circuit of FIG. 1 can not time-vary sound image localization smoothly.

Therefore, a description will be made below as to an embodiment which is capable of smoothly time-varying the localization position determined by use of delay time shorter than that corresponding to one sampling period.

Figure 3:
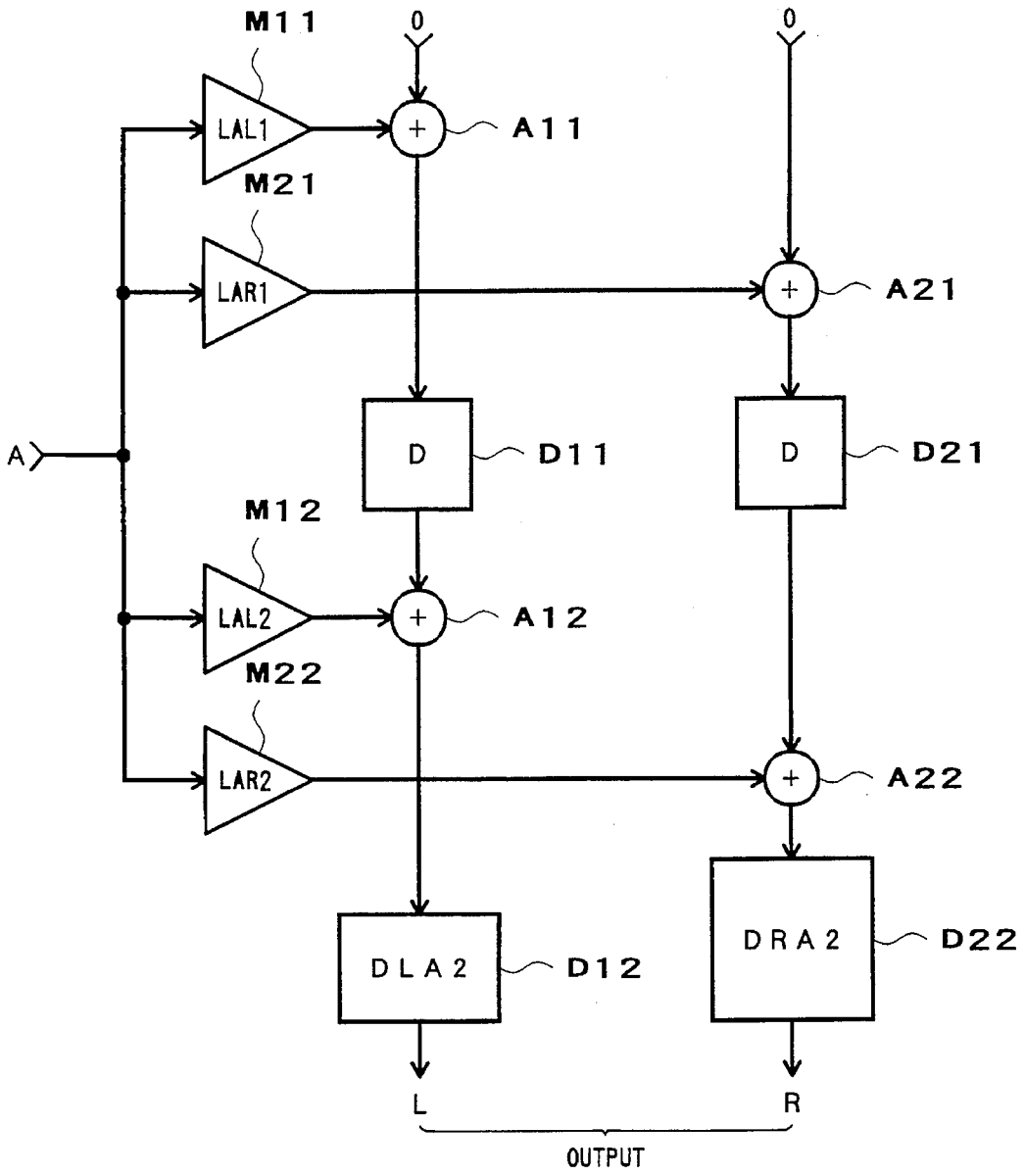
FIG. 3 shows another structural example of the localization circuit which is capable of smoothly time-varying localization by use of delay time shorter than that corresponding to one sampling period.

FIG. 3 shows another structural example of the localization control circuit which performs cross-fade interpolation to smoothly time-varying the localization position determined by the delay time corresponding to one sampling period. This figure shows the arrangement by which the tone signal from the tone source circuit A is time-varied in delay time, but illustration of the arrangement for the tone source circuits B and C is omitted here for simplicity.

In the example of FIG. 3, the localization control circuit, which performs cross-fade interpolation so as to smoothly time-vary the delay time for the tone signal from the tone source circuit A, is comprised of four multipliers M11, M12, M21 and M22, four delay circuits D11, D12, D21 and D22, and four adders A11, A12, A21 and A22. The multipliers M11 and M12, delay circuits D11 and D12, and adders A11 and A12 act to generate tone for the left channel, whereas the multipliers M21 and M22, delay circuits D21 and D22, and adders A21 and A22 act to generate tone for the right channel.

The multiplier M11 multiplies the tone signal from the tone source circuit A by a predetermined coefficient LAL1 and outputs the multiplication result to the adder A11. The adder A11 adds the output signal from the multiplier M11 to an initial value "0", and outputs the addition result to the delay circuit D11. The delay circuit D11 is a one-stage delay circuit which delays the signal from the adder A11 by predetermined time (D) corresponding to one sampling period and outputs the resultant delayed signal to the next-stage adder A12. The multiplier M12 multiplies the tone signal from the tone source circuit A by a predetermined coefficient LAL2 and outputs the multiplication result to the adder A12. The adder A12 adds together the signals from the multiplier M12 and delay circuit D11 and outputs the addition result to the next-stage delay circuit D12. The delay circuit D12, which has one stage less than the delay circuit D13 of FIG. 1, delays the signal from the adder A12 by predetermined time DLA2 and outputs the resultant delayed signal to the next-stage adder A3 that belongs to the processing system for the tone source circuit B.

In a similar manner to the above-mentioned, the multiplier M21, adder A21, delay circuit D21, multiplier M22 and adder A22 act to delay the tone signal from the tone source circuit A by predetermined delay time and output the delayed tone signal to the next-stage adder A4 that belongs to the processing system for the tone source circuit B.

The total value of the delay times D and DLA2 of the delay circuits D11 and D12 is controlled to equal the delay time DLA of the delay circuit D13 of FIG. 1, and the total value of the delay times D and DRA2 of the delay circuits D21 and D22 is controlled to equal the delay time DRA of the delay circuit D24 of FIG. 1.

Figure 4A:
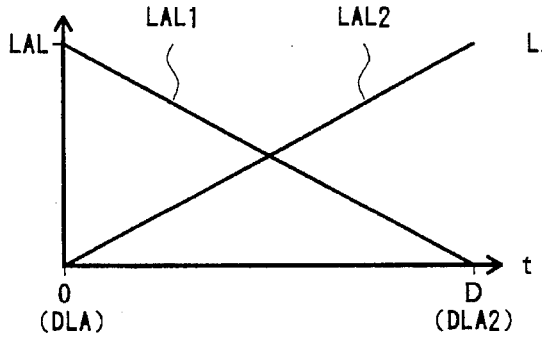
FIG. 4 shows the relationships of multiplication coefficients and delay times of two multipliers that constitute the localization control circuit of FIG. 3.

Further, in accordance with the cross-fade interpolation function shown in FIG. 4A, the total value of the multiplication coefficients LAL1 and LAL2 of the multipliers M11 and M12 is variably controlled, with lapse of time, to equal the multiplication coefficient LAL of the multiplier M1 of FIG. 1. The total value of the multiplication coefficients LAR1 and LAR2 of the multipliers M21 and M22 is variably controlled, with lapse of time, to equal the multiplication coefficient LAR of the multiplier M2 of FIG. 1, in accordance with the cross-fade interpolation function shown in FIG. 4B.

In FIG. 4A, the vertical axis represents the value of the multiplication coefficients LAR1 and LAR2 of the multipliers M11 and M12, while the horizontal axis represents the lapse of time in the cross-fade interpolation and corresponds to the length of delay time (ranging from "DLA" to "DLA2") caused by these multiplication coefficients LAR1 and LAR2. The variation range or width (from DLA to DLA2) of the delay time corresponds to a time period corresponding to one sampling period, i.e., the delay time D of the delay circuit D11.

Where the multiplication coefficient LAL1 of the multiplier M11 is equal to the multiplication coefficient LAL of the multiplier M1 of FIG. 1 and the multiplication coefficient LAL2 of the multiplier M12 is "0", the total delay time of the tone signal supplied from the tone source circuit A and output via the left channel will be D+DLA2 as the result of the signal passing through the delay circuits D11 and D12. The total delay time D+DLA2 is of the same value as the delay time DLA of the delay circuit D13 of FIG. 1.

On the other hand, where the multiplication coefficient LAL1 of the multiplier M11 is "0" and the multiplication coefficient LAL2 of the multiplier M12 is equal to the multiplication coefficient LAL of the multiplier M1 of FIG. 1, the total delay time of the tone signal from the tone source circuit A which is output via the left channel will be DLA2 as the result of the signal only passing through the delay circuit D12.

Further, in a case where each of the multiplication coefficients LAL1 and LAL2 of the multipliers M11 and M12 is half the multiplication coefficient LAL of the multiplier M1 of FIG. 1, the total delay time of the tone signal from the tone source circuit A which is output via the left channel will be delayed in such a manner that the delay time of the signal component passing through the delay circuits D11 and D12 is halved and the delay time of the signal component passing only the delay circuit D12 is also halved. Accordingly, the total delay time will be (D+DLA2+DLA2)/2=DLA2+D/2, which is equivalent to (DLA−D/2) that is smaller than the delay time of the delay circuit D13 of FIG. 1 by half of the time corresponding to one sampling frequency.

By timewise variably controlling the multiplication coefficients LAL1 and LAL2 of the multipliers M11 and M12 in accordance with the cross-fade interpolation function of FIG. 4A in the above-mentioned manner, the delay time of the tone signal from the tone source circuit A which is output via the left channel is allowed to smoothly vary within a range smaller than that corresponding to one sampling period, i.e., between the delay times DLA and DLA2.

Figure 4B:
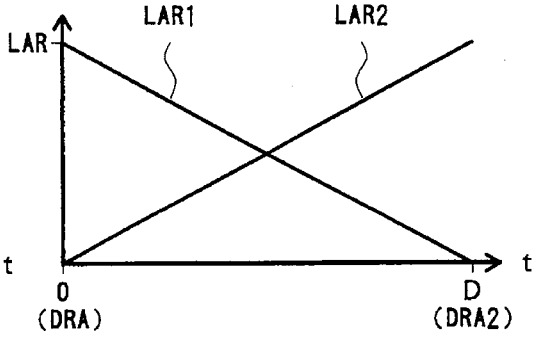

Further, similarly to the above-mentioned, by timewise variably controlling the multiplication coefficients LAR1 and LAR2 of the multipliers M21 and M22 in accordance with the cross-fade interpolation function of FIG. 4B, the delay time of the tone signal from the tone source circuit A which is output via the right channel is allowed to smoothly vary within a range smaller than the delay time corresponding to one sampling period, i.e., between the delay times DRA and DRA2.

Figure 5:
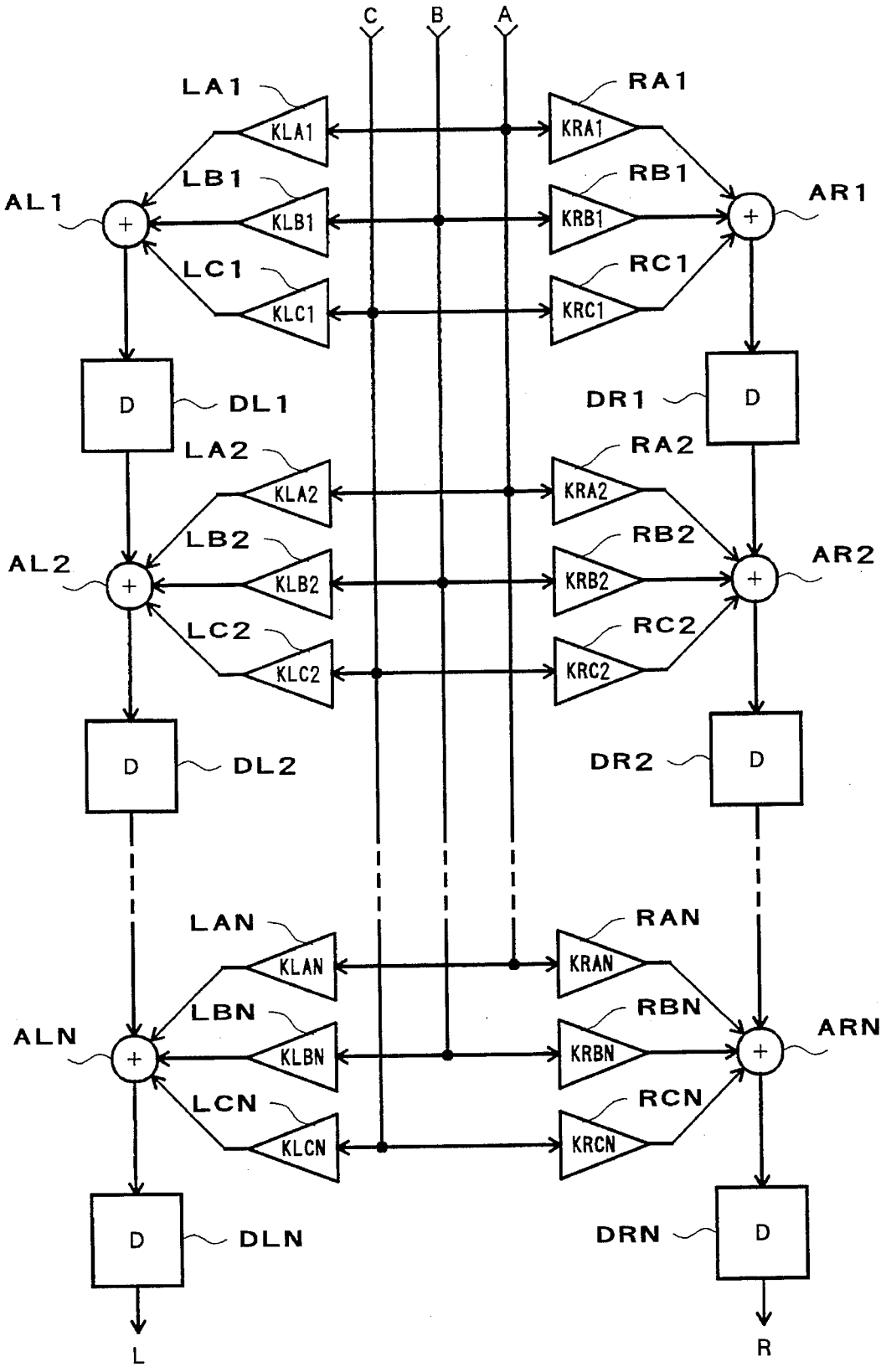
FIG. 5 shows an embodiment for implementing the localization control circuits of FIGS. 1 and 3.

FIG. 5 shows an embodiment for implementing the localization control circuits of FIGS. 1 and 3.

The localization control circuit of FIG. 5 is arranged in such a way to permit sound image localization for the tone signals from the three tone source circuits A, B and C to be made independently of each other. This localization control circuit generates tone for the left channel by means of multipliers LA1 to LAN connected to the tone source circuit A, multipliers LB1 to LBN connected to the tone source circuit B, multipliers LC1 to LCN connected to the tone source circuit C, adders AL1 to ALN and delay circuits DL1 to DLN, and generates tone for the right channel by means of multipliers RA1 to RAN connected to the tone source circuit A, multipliers RB1 to RBN connected to the tone source circuit B, multipliers RC1 to RCN connected to the tone source circuit C, adders AR1 to ARN and delay circuits DR1 to DRN.

The multiplier LA1 multiplies the tone signal from the tone source circuit A by a predetermined coefficient KLA1 and outputs the multiplication result to the adder AL1. The multiplier LB1 multiplies the tone signal from the tone source circuit B by a predetermined coefficient KLB1 and outputs the multiplication result to the adder AL1. The multiplier LC1 multiplies the tone signal from the tone source circuit C by a predetermined coefficient KLC1 and outputs the multiplication result to the adder AL1. The adder AL1 adds together the signals output from the multipliers LA1, LB1 and LC1 and then provides the addition result to the delay circuit DL1. The delay circuit DL1 is a one-stage delay circuit which delays the signal output from the adder AL1 by the time D and provides the thus-delayed signal to the next-stage adder AL2.

The multipliers LA2, LB2 and LC2 multiply the tone signals from the tone source circuits A, B and C by predetermined coefficients KLA2, KLB2 and KLC2 and outputs the multiplication result to the adder AL2. The adder AL2 adds together the output signals from the previous-stage delay circuit DL1 and the multipliers LA2, LB2 and LC2 and then provides the addition result to the delay circuit DL2. The delay circuit DL2 delays the output signal from the adder AL2 by the time D and provides the thus-delayed signal to the next-stage adder AL3 (not shown).

The multipliers LAN, LBN and LCN multiply the tone signals from the tone source circuits A, B and C by predetermined coefficients KLAN, KLBN and KLCN, respectively, and output the multiplication results to the adder ALN. The adder ALN adds together the output signals from the previous-stage delay circuit DLN-1 and the multipliers LAN, LBN and LCN and then provide the addition result to the delay circuit DLN. The delay circuit DLN delays the output signal from the adder ALN by the time D and outputs the thus-delayed signal as a final tone signal for the left channel.

In a similar manner to the above-mentioned, the multiplier RA1 multiplies the tone signal from the tone source circuit A by a predetermined coefficient KRA1 and outputs the multiplication result to the adder AR1. The multiplier RB1 multiplies the tone signal from the tone source circuit B by a predetermined coefficient KRB1 and outputs the multiplication result to the adder AR1. The multiplier RC1 multiplies the tone signal from the tone source circuit C by a predetermined coefficient KRC1 and outputs the multiplication result to the adder AR1. The adder AR1 adds together the signals output from the multipliers RA1, RB1 and RC1 and then provides the addition result to the delay circuit DR1. The delay circuit DR1 is a one-stage delay circuit which delays the signal output from the adder AR1 by the time D and provides the thus-delayed signal to the next-stage adder AR2.

The multipliers RA2, RB2 and RC2 multiply the tone signals from the tone source circuits A, B and C by predetermined coefficients KRA2, KRB2 and KRC2, respectively, and output the multiplication results to the adder AR2. The adder AR2 adds together the output signals from the previous-stage delay circuit DR1 and the multipliers RA2, RB2 and RC2 and then provides the addition result to the delay circuit DR2. The delay circuit DR2 delays the output signal from the adder AR2 by the time D and provides the thus-delayed signal to the next-stage adder AR3 (not shown).

The multipliers RAN, RBN and RCN multiply the tone signals from the tone source circuits A, B and C by predetermined coefficients KRAN, KRBN and KRCN, respectively, and output the multiplication results to the adder ARN. The adder ARN adds together the output signals from the previous-stage delay circuit DRN-1 and the multipliers RAN, RBN and RCN and then provide the addition result to the delay circuit DRN. The delay circuit DRN delays the output signal from the adder ARN by the time D and outputs the thus-delayed signal as a final tone signal for the right channel.

In the embodiment of FIG. 5, if the sampling frequency of the localization control circuit is 50 kHz, the value N is "25". That is, the localization circuit is comprised of 50 adders, 50 delay circuits and 150 multipliers. If the delay time is set to be shorter than the time corresponding to one sampling period, then the multiplication coefficients of the multipliers preceding and succeeding each multiplier may be variably controlled in accordance with the function of FIG. 4.

For example, in the case where the delay circuits D13, D35 and D50 in FIG. 1 are six-stage, two-stage and ten-stage delay circuits, respectively, the same localization control circuit as shown in FIG. 1 can be implemented by setting the multiplication coefficient of each multiplier of FIG. 5 in the following manner:

That is, the multiplication coefficient KLA7 of the multiplier LA7 is set to the coefficient LAL; the multiplication coefficient KLB13 of the multiplier LB13 to the coefficient LBL; the multiplication coefficient KLC15 of the multiplier LC15 to the coefficient LCL; the multiplication coefficient KRA9 of the multiplier RA9 to the coefficient LAR; the multiplication coefficient KRB19 of the multiplier RB19 to the coefficient LBR; the multiplication coefficient KRC19 of the multiplier RC19 to the coefficient LCR; and the multiplication coefficient of each of the other multipliers LA1 to LA6, LA8 to LA25, LB1 to LB12, LB14 to LB25, LC1 to LC14, LC16 to LC25, RA1 to RA8, RA10 to RA25, RB1 to RB18, RB20 to RB25, RC1 to RC18 and RC20 to RC25 is set to "0".

Figure 6:
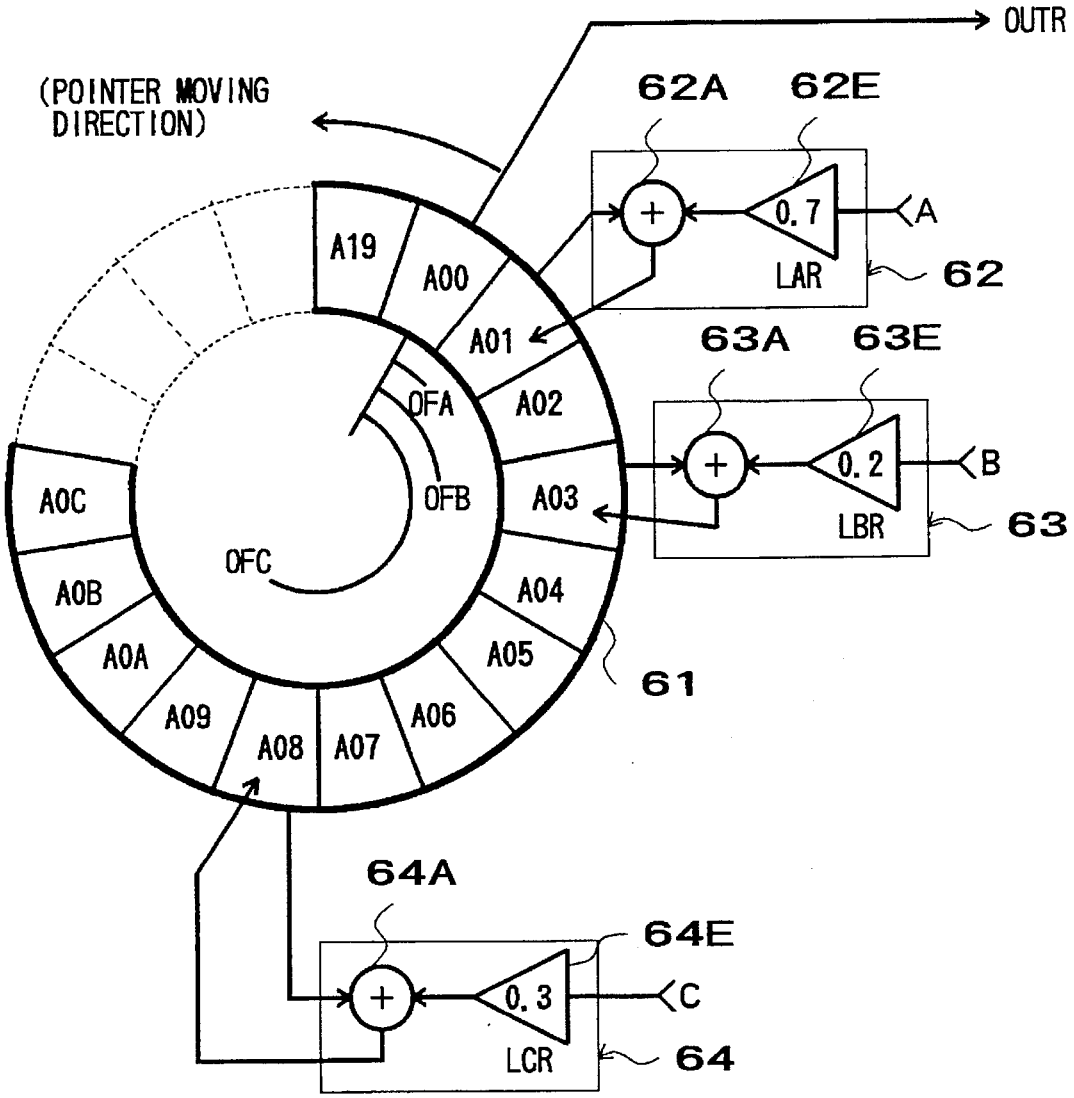
FIG. 6 shows another embodiment for implementing the localization control circuit of FIG. 1.

FIG. 6 shows another embodiment for implementing a circuit equivalent to the localization control circuit shown in FIG. 1.

The localization control circuit of FIG. 6 is arranged in such a way to permit sound image localization for the tone signals from the three tone source circuits A, B and C to be made independently of each other. Although this localization control circuit is comprised of two circuit sections, one for generating tone for the right channel and the other for generating tone for the left channel, this figure only shows the one circuit section because the two sections for the right and left channels are identical in structure.

The localization control circuit of FIG. 6 includes a ring buffer 61, an output port OUTR for reading out data from a predetermined address of the ring buffer 61, and read/write units 62, 63 and 64 that are provided in corresponding relations to the tone source circuits A, B and C. Each of the read/write units 62, 63 and 64 reads out data from a predetermined addresses of the ring buffer 61, adds thereto the tone signal from the corresponding tone source circuit 62, 63 or 64, and writes the resultant added value or sum into the same predetermined address. The localization control circuit according to this embodiment is implemented by a digital signal processor. It should be understood that values presented as coefficients LAR, LBR and LCR and address offsets OFA, OFB and OFC in the following description are only illustrative and that any other appropriate values may be set depending on the sound image localization control to be achieved.

The ring buffer 61 is a 26-stage buffer (or has a buffer size of "26"), namely, it has 26 addresses A00 to A19 (hexadecimal representation).

The right-channel output port OUTR reads out data from an address of the ring buffer 61 which corresponds to an output index and audibly reproduces the read-out data as tone for the right channel. Here, the output index indicates which address of the ring buffer 61 the output port OUTR corresponds to; in the illustrated example, the output index designates address "A00" so that the output port OUTR is caused to read out data from the address "A00".

The data read/write unit 62 includes an adder 62A and a multiplier 62E. The multiplier 62E multiplies the tone signal from the tone source circuit A by a multiplication coefficient LAR=0.7 and provides the multiplication result to the adder 62A. The adder 62A adds together the multiplication result from the multiplier 62E and data read out from an address corresponding to a first pointer of the ring buffer 61 and then rewrites the addition result into the same address. Here, the first pointer, which points to an address of the ring buffer 61 for which data read/write operation is to be performed by the data read/write unit 62, takes a value corresponding the sum between the output index and an offset value OFA. In the illustrated example, the offset value OFA is "1" corresponding to one address, and hence the first pointer takes a value corresponding to the sum "A01" between the output index address "A00" and the offset value OFA=1. Accordingly, the data read/write unit 62 reads out data from address "A01" of the ring buffer 61, adds together the read-out data and the tone signal from the tone source circuit A (having been multiplied by multiplication coefficient LAR) and rewrites the addition result into the same address "A01".

The data read/write unit 63, which is identical in structure to the data read/write unit 62, reads out data from address "A03" of the ring buffer 61 pointed to by a second pointer, adds together the read-out data and the tone signal from the tone source circuit B (having been multiplied the multiplication coefficient LBR=0.2) and rewrites the addition result into the same address "A03".

Further, the data read/write unit 64, which is also identical in structure to the data read/write unit 62, reads out data from address "A08" of the ring buffer 61 pointed to by a third pointer, adds together the read-out data and the tone signal from the tone source circuit C (having been multiplied the multiplication coefficient LCR=0.3) and rewrites the addition result into the same address "A08".

In the localization control circuit of FIG. 6, the output index decrements one by one, and accordingly the first, second and third pointers each decrement one by one. Consequently, the relationship between the ring buffer 61 and the output port OUTR and data read/write units 62 to 64 is also displaced stage by stage, so that the ring buffer 61 shift-operates as if it moved in the clockwise direction as viewed in the figure. At this time, by setting to arbitrary values the respective offset values OFA, OFB and OFC of the first, second and third pointers, the tone signals from the tone source circuits A, B and C can be output, from the output port OUTR, with such time delays corresponding to the difference between the buffer size "25" and the respective offset values OFA, OFB and OFC.

More specifically, if, for example, the sampling frequency of the localization control circuit is 50 kHz, the delay time with which the tone signal from the tone source circuit A is output from the output port OUTR will be "0.50 ms" which is the result of multiplying a value "25" (i.e., a difference obtained by subtracting the offset value OFA=1 from the buffer size value "26") by the delay time of 0.02 ms corresponding to one sampling frequency. Similarly, the delay time with which the tone signal from the tone source circuit B is output from the output port OUTR will be "0.46 ms" which is the result of multiplying a value "23" (i.e., a difference obtained by subtracting the offset value OFB=3 from the buffer size value "26") by the delay time of 0.02 ms corresponding to one sampling frequency. Further, the delay time with which the tone signal from the tone source circuit C is output from the output port OUTR will be "0.36 ms" which is the result of multiplying a value "18" (i.e., a difference obtained by subtracting the offset value OFC=8 from the buffer size value "26") by the delay time of 0.02 ms corresponding to one sampling period.

In the example of FIG. 6, if the sampling frequency of the localization control circuit is 50 kHz, the possible delay time of each tone signal output from the output port OUTR is an integer multiple of the above-mentioned delay time corresponding to one sampling frequency (0.02 ms), and hence it is difficult to control the delay time more smoothly than that. Therefore, a description will be made as to an embodiment which is capable of smoothly time-varying the sound image localization by use of delay time corresponding to one sampling frequency.

Figure 7:
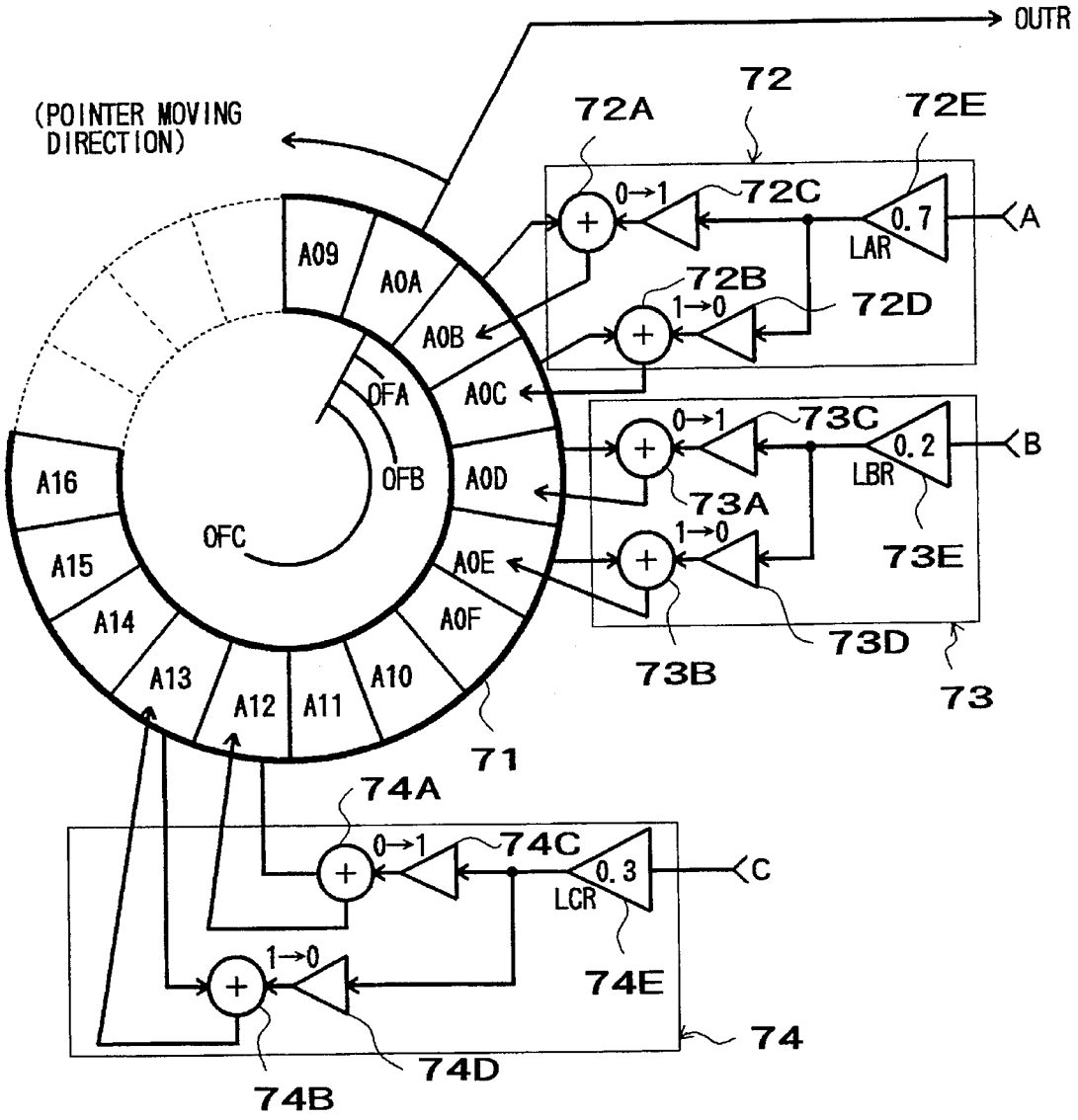
FIG. 7 shows another example of the localization control circuit of FIG. 6 which is comprised of a ring buffer capable of smoothly time-varying localization by use of delay time shorter than that corresponding to one sampling period.

FIG. 7 shows another example of the localization control circuit of FIG. 6 which is capable of smoothly time-varying the sound image localization by use of delay time smaller than the delay time corresponding to one sampling frequency.

The localization control circuit of FIG. 7 is arranged in such a way to permit sound image localization for the tone signals from the three tone source circuits A, B and C independently of each other. Although this localization control circuit is comprised of two circuit sections, one for generating tone for the right channel and the other for generating tone for the left channel, this figure only shows the one circuit section because the two sections for the right and left channels are identical in structure.

The localization control circuit of FIG. 7 includes a ring buffer 71, an output port OUTR for reading out data from a predetermined address of the ring buffer 71, and read/write units 72, 73 and 74 that are provided in corresponding relations to the tone source circuits A, B and C. Each of the read/write units 72, 73 and 74 reads out data from a predetermined addresses of the ring buffer 71, adds thereto the tone signal from the corresponding tone source circuit 72, 73 or 74, and rewrites the resultant added value into the same predetermined address.

Similarly to the ring buffer 61 of FIG. 6, the ring buffer 1 is a 26-stage buffer (buffer size of "26"), namely, has 26 addresses A00 to A19.

The right-channel output port OUTR reads out data from an address of the ring buffer 71 which corresponds to an output index and audibly reproduces the read-out data as tone for the right channel. Here, the output index indicates which address of the ring buffer 71 the output port OUTR corresponds to; in the illustrated example, the output index designates address "A0A" so that the output port OUTR is caused to read out data from the address "A0A".

The data read/write unit 72 includes adders 72A, 72B and multipliers 72D and 72E. The multiplier 72E multiplies the tone signal from the tone source circuit A by a multiplication coefficient LAR=0.7 and provides the multiplication result to the multipliers 72C and 72D. The multiplier 72C multiples the output signal from the multiplier 7E by a multiplier coefficient ranging from "0" to "1" and then provides the multiplication result to the adder 72A. The multiplier 72B multiples the output signal from the multiplier 7E by a multiplier coefficient ranging from "0" to "1" and then provides the multiplication result to the adder 72B. The sum of the multiplication coefficients of the multipliers 72C and 72D is set to be "1".

The adder 72A adds together the multiplication result from the multiplier 72C and data read out from an address corresponding to a first pointer of the ring buffer 71 and then rewrites the addition result into the same address. Here, the first pointer, which points to an address of the ring buffer 71 for which data read/write operation is to be performed by the adder 72A of the data read/write unit 72, takes a value corresponding the sum between the output index and an offset value OFA. In the illustrated example, the offset value OFA is "1" corresponding to one address, and hence the first pointer takes a value corresponding to the sum "A0B" of the output index address "A0A" and the offset value OFA=1.

The adder 72B adds together the multiplication result from the multiplier 72D and data read out from an address corresponding to a fourth pointer of the ring buffer 71 and then rewrites the addition result into the same address. Here, the first pointer, which points to an address of the ring buffer 71 for which data read/write operation is to be performed by the adder 72B of the data read/write unit 72, takes a value greater than the first pointer by one address. In the illustrated example, the offset value OFA is "1", and hence the fourth pointer takes a value A0C greater by "1" than the sum of the output index address "A0A" and the offset value OFA=1.

Accordingly, the data read/write unit 72 reads out data from address "A0B", adds together the read-out data and a part of the value obtained by multiplying the tone signal from the tone source circuit A by multiplication coefficient LAR (i.e., the multiplication result of the multiplier 72C), and rewrites the addition result into the same address "A0B". The data read/write unit 72 also reads out data from address "A0C", adds together the read-out data and the remaining part of that value obtained by multiplying the tone signal from the tone source circuit A by multiplication coefficient LAR (i.e., the multiplication result of the multiplier 72D), and rewrites the addition result into the same address "A0C".

Thus, in the case where the sampling frequency is 50 KHz, the data read/write unit 72 can freely vary the possible delay time of the tone signal, output from the output port OUTR, within a range from 0.5 ms to 0.48 ms, and accordingly the localization control circuit is allowed to smoothly move the localization.

The data read/write unit 73, which is identical in structure to the above-mentioned data read/write unit 72, reads out data from address "A0D", adds together the read-out data and a part of the value obtained by multiplying the tone signal from the tone source circuit B by multiplication coefficient LBR (i.e., the multiplication result of the multiplier 73C), and rewrites the addition result into the same address "A0D". The data read/write unit 73 also reads out data from address "A0E", adds together the read-out data and the remaining part of that value obtained by multiplying the tone signal from the tone source circuit B by multiplication coefficient LBR (i.e., the multiplication result of the multiplier 73D), and rewrites the addition result into the same address "A0E".

Thus, in the case where the sampling frequency is 50 KHz, the data read/write unit 73 can freely vary the possible delay time of the tone signal, output from the output port OUTR, within a range from 0.46 ms to 0.44 ms, and accordingly the localization control circuit is allowed to smoothly move the localization.

The data read/write unit 74, which is also identical in structure to the above-mentioned data read/write unit 72, reads out data from address "A12", adds together the read-out data and a part of the value obtained by multiplying the tone signal from the tone source circuit C by multiplication coefficient LCR (i.e., the multiplication result of the multiplier 74C), and rewrites the addition result into the same address "A12". The data read/write unit 73 also reads out data from address "A13", adds together the read-out data and the remaining part of that value obtained by multiplying the tone signal from the tone source circuit C by multiplication coefficient LCR (i.e., the multiplication result of the multiplier 74D), and rewrites the addition result into the same address "A13".

Thus, in the case where the sampling frequency is 50 KHz, the data read/write unit 74 can freely vary the possible delay time of the tone signal, output from the output port OUTR, within a range from 0.36 ms to 0.34 ms, and accordingly the localization control circuit is allowed to smoothly move the localization.

Figure 8:
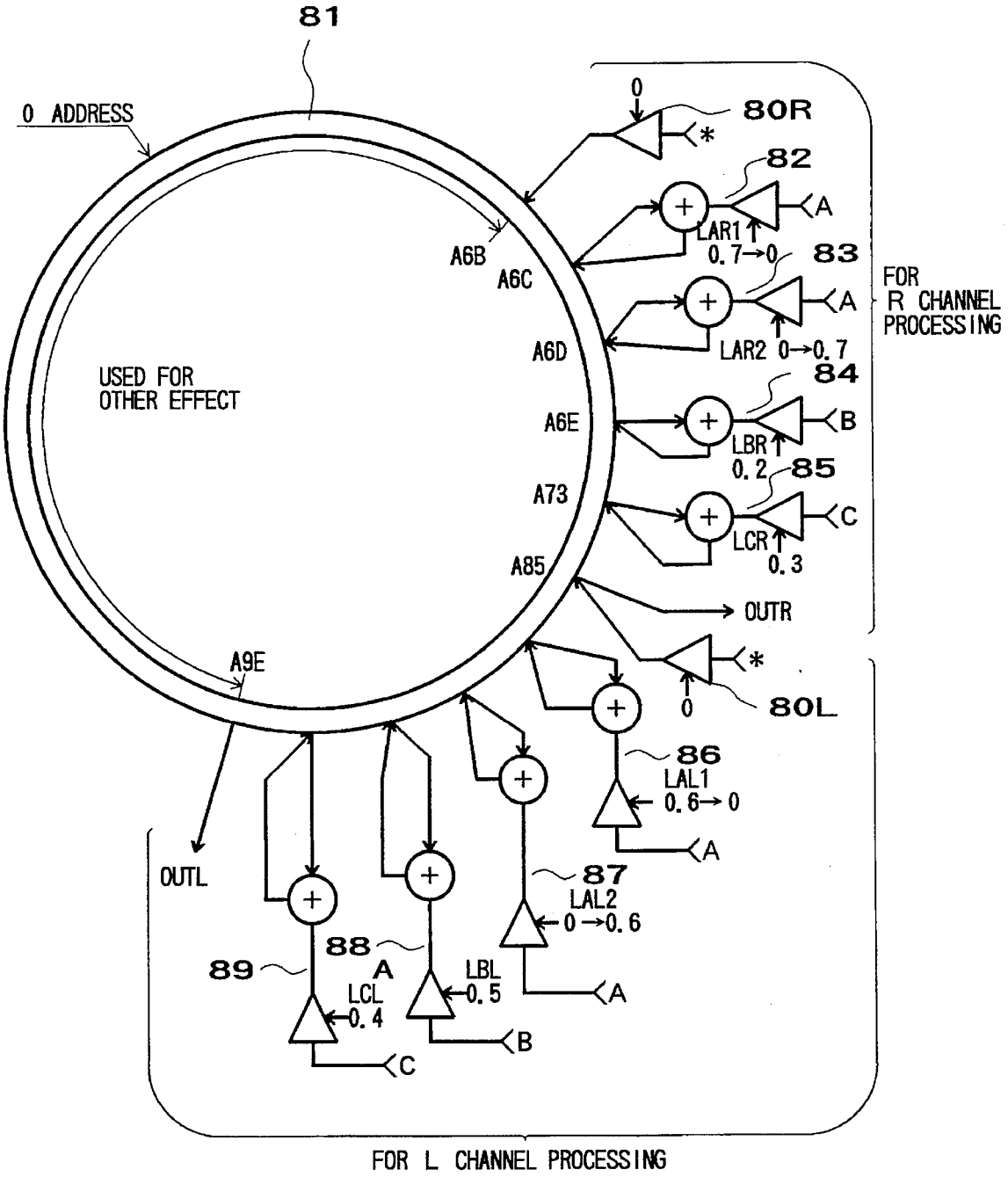
FIG. 8 shows a modification of the localization control circuit of FIGS. 6 and 7.

FIG. 8 is a diagram showing a modified example of the localization control circuits of FIGS. 6 and 7.

While the embodiments of FIGS. 6 and 7 have been described above as using a single ring buffer 61 or 71 for the right or left channel, the modified example of FIG. 8 is characterized by using a part of a greater-size ring buffer 81 for both the right and left channels and the remaining part of the ring buffer for effect imparting processing. This modified localization control circuit is implemented by digital signal processor. Although the example of FIG. 8 will be described below on the assumption that the settings of coefficients and address offsets in data read/write units are the same as in FIGS. 6 and 7, these settings may of course be varied as desired.

The localization control circuit is comprised of a part of the ring buffer 81, right and left channel output ports OUTR and OUTL for reading out data at respective predetermined addresses of the ring buffer 81, reset units 80R and 80L for resetting data at respective predetermined addresses of the ring buffer 81, and a plurality of data read/write units 82 to 89. Each of the data read/write units 82 to 89 reads out data from a predetermined address of the ring buffer 81, adds together the read-out data and the tone signal from the corresponding tone circuit A, B or C, and rewrites this addition result into the same address. Each of the data read/write units 82 to 89 is comprised of an adder and a multiplier.

The ring buffer 81 has for example 256 stages (i.e., 256 addresses "A00" to "AFF"), and its addresses are set in such a way as if the ring buffer 81 rotates in the clockwise direction as viewed in the figure in response to pointers decrementing one by one. In this modified example, 51 stages of the ring buffer 81 are used for the localization control circuit; about half (26) of the 51 stages is used for the right channel processing, and the remaining half (26) of the 51 stages is used for the left channel processing. The reason why the buffer size for the localization control circuit is "51" is that the output port R and reset unit 80L access a common address designated by a same pointer. In this example, 51 stages of addresses "A6B" to "A9E" are used for the localization control circuit, among which 26 stages of addresses A6B to A85 are for the right channel processing and 26 stages of addresses A6B to A85 are for the left channel processing.

The right-channel reset unit 80R, which is comprised of a multiplier to which a multiplication coefficient "0", resets data at an address of the ring buffer 81 which corresponds to a right-channel reset index RESET INDEXR (RING BUFFER(RESET INDEXR)). Here, the right-channel output index indicates which address of the ring buffer 81 the right-channel reset unit 80R corresponds to; in the illustrated example, the right-channel reset index designates address "A6B", and the right-channel reset unit 80R resets data at address "A6B".

Data read/write units 82 and 83 are used to perform the right-channel cross-fade interpolation operation for tone color A, and data read/write units 86 and 87 are used to perform the left-channel cross-fade interpolation operation for tone color A. In each set of the data read/write units 82 and 83 (or 86 and 87) for performing the cross-fade interpolation operation, one of the units corresponds to an interpolation starting point, and the other unit corresponds to an interpolation target point. For example, when a right-channel sound image localization variable for tone color A is to be timewise moved from a current value to a specific target value, one unit corresponding to the current value (e.g., unit 82) is caused to correspond to the interpolation starting point and the other unit (e.g., unit 83) is caused to correspond to the interpolation target value so that cross-fade interpolation is performed between the two units in accordance with the passage of time.

In the example of FIG. 8, for the right channel of tone color A, the unit 82 corresponds to the interpolation starting point and the unit 83 corresponds to the interpolation target point. For the left channel of tone color A, the unit 86 corresponds to the interpolation starting point and the unit 87 corresponds to the interpolation target point. Therefore, in this example, address offset value OFA1 of the unit 82 corresponds to delay time at the interpolation starting point for the right channel of tone color A, and address offset value OFA2 of the unit 83 corresponds to delay time at the interpolation target (ending) point for the left channel of tone color A. Further, in this example, address offset value OFA3 of the unit 86 corresponds to delay time at the interpolation starting point for the left channel of tone color A, and address offset value OFA4 of the unit 87 corresponds to delay time at the interpolation target (ending) point for the left channel of tone color A. As to multiplication coefficient LAR2 of the unit 83, the numerical value example "0→0.7" of FIG. 8 means that the target value of multiplication coefficient LAR for the right channel of tone color A is "0.7" and the coefficient LAR2 is, during cross-fade interpolation operation, smoothly time-varied from the initial value of "0" to the target value of "0.7". Likewise, as to multiplication coefficient LAR1 of the unit 82, the numerical value example "0.7→0" of FIG. 8 means that the coefficient LAR1 is, for cross-fade interpolation, time-varied with respect to the above-mentioned coefficient LAR2 as the complement of "0.7". As to multiplication coefficients LAL2 and LAL1 of the units 87 and 86, the numerical value examples "0→0.6" and "0.6→0" of FIG. 8 have similar meaning to the above-mentioned. As the result, during the cross-fade interpolation operation, the delay time is caused to time-vary smoothly so that smooth movement of sound image localization is achieved.

Thus, in the example of FIG. 8, the data read/write unit 82 multiplies the tone signal from the tone source circuit A by the multiplication coefficient LAR1 time-varying from "0.7" to "0" during the cross-fade interpolation operation, adds together the multiplication result and data read out from an address of the ring buffer 81 corresponding to a first pointer. Here, the first pointer points to an address of the ring buffer 81 for which data read/write operation is to be performed by the data read/write unit 82 and takes a value equivalent to the sum of the right-channel reset index and an offset value OFA1 (RESET INDEXR+OFA1).

In the example of FIG. 8, the offset value OFA1 is "1" corresponding to one address as in the embodiments of FIGS. 6 and 7, and the first pointer is at a value corresponding to the sum "A6C" of the right-channel reset index "A6B" and the offset value OFA1=1. Consequently, in a similar manner to the data read/write unit 62 of FIG. 6, the adder of the data read/write unit 82 is caused to read out data from the address "A6C" of the ring buffer 82, adds thereto the value obtained by multiplying the tone signal from the tone source circuit A by multiplication coefficient LAR1 (i.e., the multiplication result of the associated multiplier), and rewrites the addition result into the same address "A6C".

Also, the data read/write unit 83 multiplies the tone signal from the tone source circuit A by a multiplication coefficient LAR2 time-varying from "0" to "0.7" during the cross-fade interpolation operation, adds together the multiplication result and data read out from an address of the ring buffer 81 which corresponds to a second pointer, and rewrites this addition result into the same address. The sum of the multiplication coefficients of the respective multipliers of the data read/write units 82 and 83 is set to be "0.7". Here, the second pointer points to an address of the ring buffer 81 for which data read/write operation is to be performed by the data read/write unit 83 and takes a value equivalent to the sum of the right-channel reset index and an offset value OFA2 (RESET INDEXR+OFA2).

In the illustrated example of FIG. 8, the offset value OFA2 is "2" that is greater than the offset value OFA1 by one address, and hence the second pointer takes a value "A6D" equivalent to the sum of the right-channel reset index "A6B" and the offset value OFA2 (=2). Accordingly, in a similar manner to the data read/write unit 72, the data read/write unit 82 is caused to read out data from the address "A6D", adds together the read-out data and the tone signal from the tone source circuit A (having been multiplied by the multiplication coefficient LAR2=0 to 0.7), and rewrites this addition result into the same address "A6D".

Namely, in a similar manner to the data read/write unit 72 of FIG. 7, the data read/write units 82 and 83 read out data from address "A6C", add thereto the value obtained by multiplying the tone signal from the tone source circuit A by multiplication coefficient LAR1 (i.e., the multiplication result of the multiplier of the unit 82) and rewrite the addition result into the address "A6C", and at the same time, read out data from address "A6D", add thereto the value obtained by multiplying the tone signal from the tone source circuit A by multiplication coefficient LAR2 (i.e., the multiplication result of the multiplier of the unit 83) and rewrite the addition result into the address "A6D".

Thus, in the case where the sampling frequency is 50 kHz, the cross-fade interpolation by the data read/write units 82 and 83 allow the delay time of the tone signal of tone color A, output from the output port OUTR, to be smoothly varied within a range from a current value (e.g., 0.50 ms) to a target value (e.g., 0.48 ms), and accordingly the localization control circuit is allowed to smoothly move the localization.

The data read/write unit 84 multiplies the tone signal from the tone source circuit B by a multiplication coefficient LBR of "0.2", adds together the multiplication result and data read out from an address of the ring buffer 81 which corresponds to a third pointer, and rewrites this addition result into the same address. Here, the third pointer points to an address of the ring buffer 81 for which data read/write operation is to be performed by the data read/write unit 84 and takes a value equivalent to the sum of the right-channel reset index and an offset value OFBR (RESET INDEXR+OFBR).

In the illustrated example of FIG. 8, the offset value OFBR is "3" corresponding to three addresses as in the embodiment of FIGS. 6 and 7, and the third pointer takes a value "A6E" equivalent to the sum of the right-channel reset index "A6B" and the offset value OFBR (=3). Accordingly, in a similar manner to the data read/write unit 63 of FIG. 6, the adder of the data read/write unit 84 is caused to read out data from the address "A6E", adds together the read-out data and the result of multiplying the tone signal from the tone source circuit B by the multiplication result LBR=0.2 (i.e., the multiplication result of the multiplier of the data read/write unit 84), and rewrites this addition result into the same address "A6E".

The data read/write unit 85 multiplies the tone signal from the tone source circuit C by a multiplication coefficient LCR of "0.3", adds together the multiplication result and data read out from an address of the ring buffer 81 which corresponds to a fourth pointer, and rewrites this addition result into the same address. Here, the fourth pointer points to an address of the ring buffer 81 for which data read/write operation is to be performed by the data read/write unit 85 and takes a value equivalent to the sum of the right-channel reset index and an offset value OFBR (RESET INDEXR+OFCR).

In the illustrated example of FIG. 8, the offset value OFCR is "8" corresponding to eight addresses as in the embodiment of FIGS. 6 and 7, and the fourth pointer takes a value "A73" equivalent to the sum of the right-channel reset index "A6B" and the offset value OFCR (=8). Accordingly, in a similar to the data read/write unit 64 of FIG. 6, the adder of the data read/write unit 85 is caused to read out data from the address "A73", adds together the read-out data and the result of multiplying the tone signal from the tone source circuit C by the multiplication result LCR=0.3 (i.e., the multiplication result of the multiplier 85E), and rewrites this addition result into the same address "A6E".

The right-channel output port OUTR reads out data from an address of the ring buffer 81 which corresponds to a right-channel output index (RING BUFFER(OUTPUT INDEXR) and audibly reproduces the read-out data as tone for the right channel. Here, the right-channel output index indicates which address of the ring buffer 81 the right-channel output port OUTR corresponds to, and its value is equivalent to the sum of the right-channel reset index and an offset value "19" corresponding to the buffer size of 26 stages (RESET INDEXR+19). In the illustrated example, the right-channel output index designates address "A85" so that the right-channel output port OUTR is caused to read out data from the address "A85" of the ring buffer 81.

The right-channel reset unit 80L, which is comprised of a multiplier to which a multiplication coefficient "0", resets data stored at an address of the ring buffer 81 which corresponds to the above-mentioned right-channel reset index RESET INDEXR (RING BUFFER(OUTPUT INDEXL)). That is, after the right-channel output port OUTR has read out data from an address of the ring buffer 81 corresponding to the right-channel output index, the right-channel reset unit 80L resets the data at the address. Therefore, the above-mentioned right-channel output index also functions as the left-channel reset index RESET INDEXL that indicates which address of the ring buffer 81 the left-channel reset unit 80L corresponds to. In the figure, the right-channel output index (left-channel reset index) is shown as designating address "A85", and the left-channel reset unit 80L is shown as resetting the data at that address "A85".

The data read/write unit 86 multiplies the tone signal from the tone source circuit A by a multiplication coefficient LAL1 time-varying from "0.6" to "0" during the cross-fade interpolation operation, adds together the multiplication result, data read out from an address of the ring buffer 81 corresponding to a fifth pointer, and then rewrites this addition result into the same address. Here, the fifth pointer points to an address of the ring buffer 81 for which data read/write operation is to be performed by the data read/write unit 86 and takes a value equivalent to the sum of the right-channel reset index and an offset value OFA3 (RESET INDEXL+OFA3).

The data read/write unit 87 multiplies the tone signal from the tone source circuit A by a multiplication coefficient LAR2 time-varying from "0" to "0.6", adds together the multiplication result and data read out from an address of the ring buffer 81 which corresponds to a sixth pointer, and rewrites this addition result into the same address. The sum of the multiplication coefficients of the respective multipliers of the data read/write units 86 and 87 (LAL1+LAL2) is set to be "0.6". Here, the sixth pointer points to an address of the ring buffer 81 for which data read/write operation is to be performed by the data read/write unit 87 and takes a value equivalent to the sum of the left-channel reset index and an offset value OFA4 (RESET INDEXL+OFA4).

In the illustrated example of FIG. 8, the offset value OFA4 is greater than the offset value OFA3 by one address. The data read/write units 86 and 87 can freely vary the possible delay time of the tone signal output from the output port OUTL, and accordingly the sound image localization can be moved smoothly.

The data read/write unit 88 multiplies the tone signal from the tone source circuit B by a multiplication coefficient LBR of "0.5", adds together the multiplication result and data read out from an address of the ring buffer 81 which corresponds to a seventh pointer, and rewrites this addition result into the same address. Here, the seventh pointer points to an address of the ring buffer 81 for which data read/write operation is to be performed by the data read/write unit 88 and takes a value equivalent to the sum of the left-channel reset index and an offset value OFBL (RESET INDEXL+OFBL).

The data read/write unit 89 multiplies the tone signal from the tone source circuit C by a multiplication coefficient LCL of "0.4", adds together the multiplication result and data read out from an address of the ring buffer 81 which corresponds to an eighth pointer, and rewrites this addition result into the same address. Here, the eighth pointer points to an address of the ring buffer 81 for which data read/write operation is to be performed by the data read/write unit 89 and takes a value equivalent to the sum of the left-channel reset index and an offset value OFCL (RESET INDEXL+OFCL).

The left-channel output port OUTL reads out data from an address of the ring buffer 81 which corresponds to a left-channel output index and audibly reproduces the read-out data as tone for the left channel. Here, the left-channel output index indicates which address of the ring buffer 81 the left-channel output port OUTL corresponds to, and its value is equivalent to the sum of the left-channel reset index and an offset value "19" corresponding to the buffer size of 26 stages (RESET INDEXL+19). In the illustrated example, the left-channel output index designates address "A85" so that the left-channel output port OUTL is caused to read out data from the address "A9E" of the ring buffer 81.

Generally speaking, in the illustrated example of FIG. 8, by setting to arbitrary values the respective offset values OFA1, OFA2, OFBR, OFCR, OFA3, OFA4, OFBL and OFCL of the first to eighth pointers, the tone signals supplied from the tone source circuits A, B and C can be output, from the output ports OUTR and OUTL, with such time delays corresponding to the respective offset values. For instance, if, in the example of FIG. 8, the sound image localization movement further continues after the coefficient LAR2 of the unit 83 has reached the target value of 0.7, the offset value OFA1 of the unit 82 is changed to a value corresponding to a next delay time target value and the initial value of each interpolating coefficient LAR1, LAR2 is set as necessary for new cross-fade interpolation. The FIG. 8 embodiment has been described above in relation to the case where only the tone signal supplied from the tone source circuit A is applied to cross-fade interpolation so as to achieve smooth movement of sound image localization. It should also be apparent that, by mere addition of data read/write units including adders and multipliers for the purpose of cross-fade interpolation, similar smooth movement of sound image localization can be achieved for the tone signals from the other tone source circuits B and C. It should also be apparent that the cross-fade interpolation operation can be used not only for time-varying sound image localization but also for achieving delay time that is not an integer multiple of one sampling period.

In order to simultaneously move tones of tone colors A, B and C, two sets of the data read/write units are needed for effecting cross-fade interpolation on each tone color, and hence a total of six data read/write units are required. However, if only one of the three tone colors is to be moved at a time, only one et of the data read/write units may be used in turn among the tone colors, and consequently it is sufficient to only provide a total of four data read/write units. This will achieve increased efficiency.

In the case where the localization control circuit 1A having such an essential configuration as shown in FIG. 6, 7 or 8 is implemented by a DSP, the ring buffer 61, 71 or 81 is implemented by internal RAM of the DSP, and the data read/write units 62 to 64, 72 to 74 or 82 to 89 each including an adder and a multiplier are implemented by an appropriate number of microprogram steps of the DSP. In such a case, for sound image localization control of tone corresponding to each tone color (in other words, tone controlled by common sound image localization control parameter), it is necessary to allocate microprogram steps corresponding to a pair or set of the right and left data read/write units (for instance, a pair of the units 82 and 83 for tone color A, a pair of the units 84 and 86 for tone color B, or the like). In order to achieve timewise movement of sound image localization by time-varying the sound image localization control parameter, it is necessary, as mentioned earlier, to allocate microprogram steps corresponding to two data read/write units for each of the right and left channels (for instance, units 82, 83 and 86, 87).

Of course, in practice, the DSP implementing the tone localization control circuit 1A can only perform arithmetic operation corresponding to a specific maximum number (provisionally referred to as "N") of the data read/write units. Therefore, for each tone signal input from the tone source 19 to the localization control circuit 1A or DSP, it is necessary to assign the required operation to appropriate "data read/write units" formed within the DSP and, in accordance with the assignment, to supply each of the units with proper sound image localization parameter (multiplication coefficient and delay-time-setting address offset value data). In the embodiment of FIG. 2, such assignment and parameter supply are performed under the control of the microcomputer containing the CPU 10. For instance, in the case where tone signals input from the tone source 19 to the localization control circuit 1A or DSP are three channel tone signals of tone colors A, B and C as in the above-mentioned example and no cross-fade interpolation operation is to be made, it is sufficient to only implement three sets of, i.e., six "data read/write units" within the DSP; however, if cross-fade interpolation operation is to be made simultaneously for all of the three-channel tone signals, it is necessary to implement six sets of, i.e., 12 "data read/write units" within the DSP. In the latter case, it is necessary to always reserve four "data read/write units" for each (each channel) input tone signal, and thus when no sound image localization is to be made, two data read/write units will not be used at all because no cross-fade interpolation operation is made. This will be quite a waste. To avoid such a waste, it will be effective to switch the assignment in such a manner that four data read/write units are reserved for each channel input tone signal when the sound image moving mode is ON but only two data read/write units are reserved when the sound image moving mode is not ON for each channel input tone signal. It should be appreciated that when cross-fade interpolation operation is to be made, it is sufficient that interpolation operation based on such cross-fade interpolation function as shown in FIGS. 4A and 4B be performed via an interpolation circuit provided within the localization control circuit 1A or DSP to thereby produce a pair of differentially time-varying coefficients (for instance, LAR1 and LAR2) and then the produced coefficients be input as coefficients for two cross-fade interpolating units (for instance, units 82 and 83).

The operation of the electronic musical instrument of FIG. 2 will now be described in detail below primarily in terms of example operation or processing performed by the microcomputer containing the CPU 10, on the assumption that the electronic musical instrument simultaneously generates tones of three different tone colors in response to each key depression.

Figure 9:
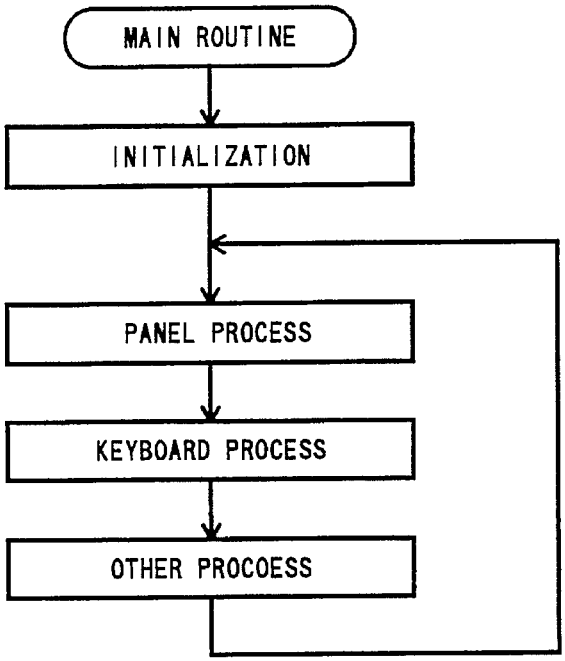
FIG. 9 is a flowchart of a main routine performed by a microcomputer of FIG. 2.

FIG. 9 is a flowchart showing an example of a main routine performed by the microcomputer.

First, in response to power-on, initialization process is performed to set various data stored in the data and working RAM 12 to respective initial values.

In panel process, various event operations are performed depending on the respective operational states of the individual operators on the operation panel 18.

In keyboard process, various operations are performed in response to a key depression or key release event signal given from the keyboard interface 14.

In other process, various other operations than the above-mentioned are performed.

Figure 10:
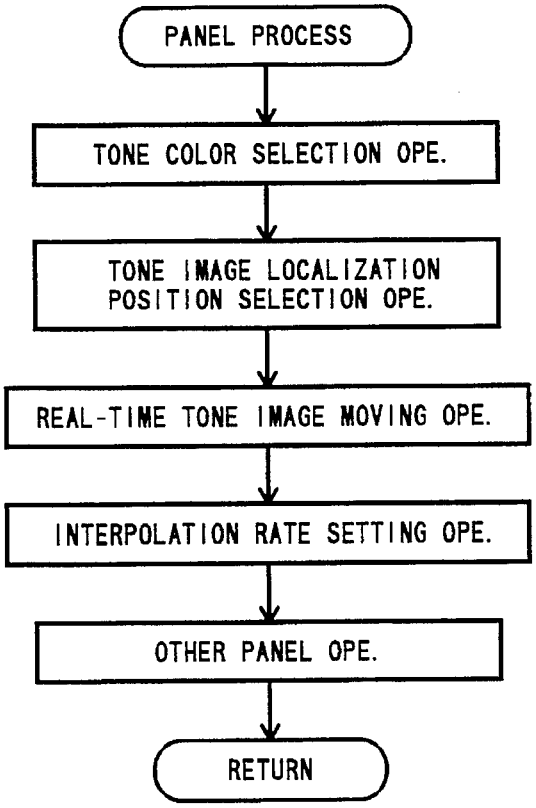
FIG. 10 is a flowchart showing the detail of a panel process of FIG. 9.

FIG. 10 illustrates the detail of the panel process of FIG. 9.

First, the tone color selection operation is performed to selectively set three kinds of tone color on the basis of the player's operation on the operation panel 18.

Then, the sound image localization position selection process is performed to set the positions where the selected three tone colors are to be localized, such as by moving symbol marks (images) of musical instruments, corresponding to the tone colors, on the display 16 in response to the operation amount of sound image setting operators provided on the operation panel 18. Namely, the player can readily set the sound image localization position of each tone color, by only causing the corresponding symbol mark to be shown at a suitable position on the display 18 via the sound image setting operator.

Real time sound image moving process is performed to move a currently generated sound image by actuating a predetermined operator such as a joy stick during a performance. This process will be described in detail later with reference to FIG. 12.

Interpolation rate setting process is directed to change the interpolation rate of the cross-fade interpolation operation performed by the DSP. For example, when the user does not like the manner in which the sound image is moved during the real time sound image moving process, e.g., when the sound image movement presents poor fallibility to the movement of the joy stick, the user may adjust the setting of an interpolation rate related operator. The interpolation rate setting process is performed, in response to the player's adjustment of the interpolation rate related operator, to adjust the interpolation rate of interpolation circuit 93 to increase. Thus, interpolation rate data set by the CPU 10 is given to the DSP 1A to establish an interpolation rate of cross-fade interpolation operation in the DSP 1A.

In other panel process, other operations such as setting of data that are not directly associated with the present invention are performed.

Figure 11:
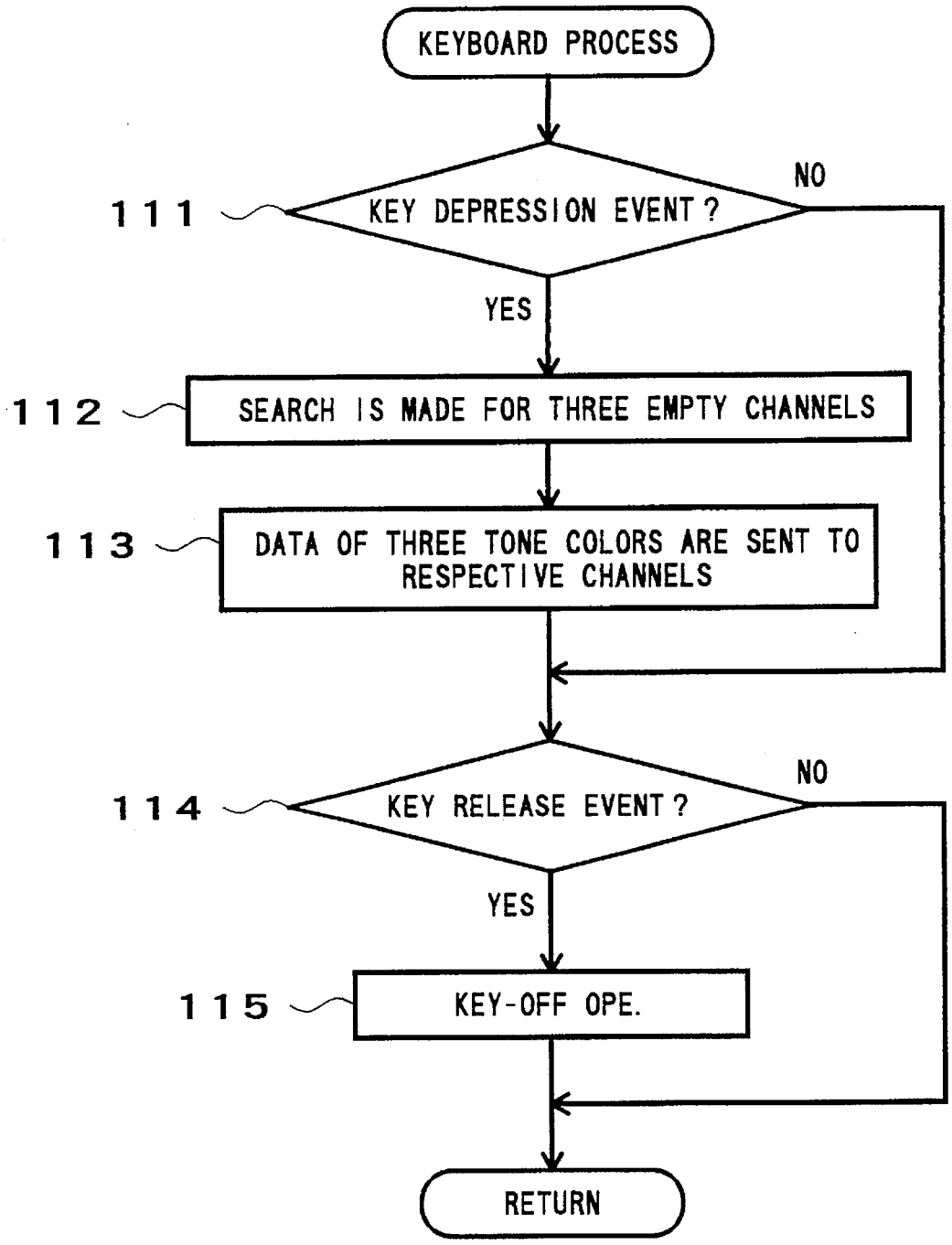
FIG. 11 is a flowchart showing the detail of a keyboard process of FIG. 9.

FIG. 11 illustrates the detailed flow of the keyboard process of FIG. 9, which will be described below step by step.

Step 111: A determination is made as to whether or not the key event passed from the keyboard interface 14 is a key depression event. If answered in the affirmative (YES), the flow proceeds to next step 112, but if not, the flow jumps to step 114.

Step 112: This step examines whether three tone generation channels for generating tone signals corresponding to the three tone colors are available in the tone source.

Step 113: Data for generating tones corresponding to the three tone colors are supplied to the respective channels searched for in the preceding step 112.

Step 114: A determination is made as to whether the key event passed from the keyboard interface 14 is a key release event. The flow goes to next step 115 if the key event is a key release event, but otherwise returns to the main routine.

Step 115: This step performs a key-off process corresponding to the key-off event.

By the above-mentioned operations, tone signals of the three tone colors are generated by the tone source 19 in response to a key-on signal and then are separately input to the localization control circuit (DSP) 1A.

Figure 12:
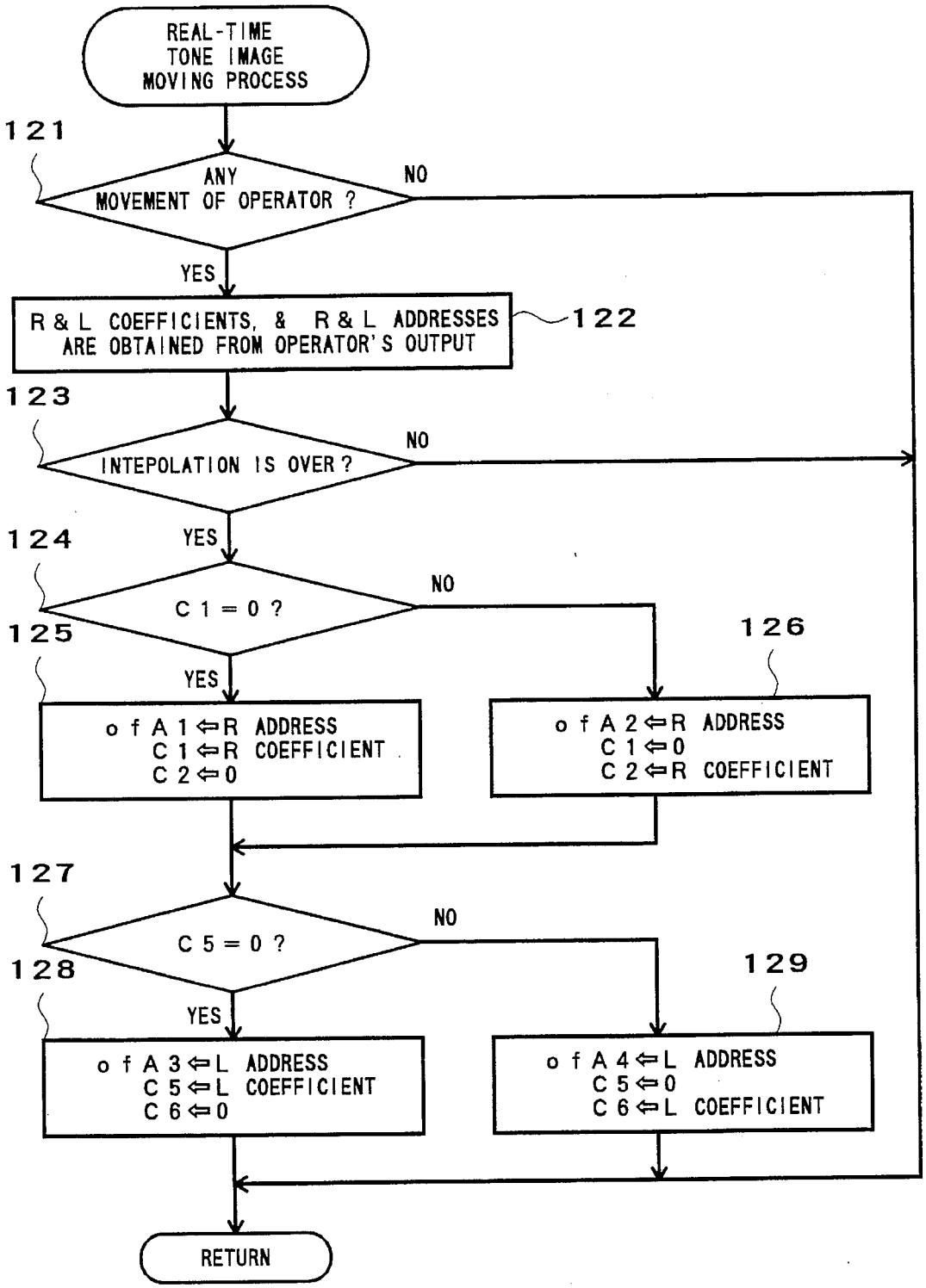
FIG. 12 is a flowchart showing the detail of a real-time sound image moving process of FIG. 9.

FIG. 12 illustrates the detailed flow of the real time sound image moving process of FIG. 9, which will be described below step by step. The figure illustrates the contents of operations on one input tone signal (of one tone color), which is based on the assumption that four "data read/write units" are reserved for the cross-fade interpolation operation.

Step 121: It is determined whether the joy stick or other related operator has been moved. With an affirmative determination, the flow proceeds to step 122; if not, the flow returns to the main routine.

Step 122: In response to the output from the operator, there are obtained, as target values of sound image localization movement, coefficients for the right and left channels (which will hereinafter be called R and L coefficients), and delay time, namely, address offset values for the right and left channels (which will hereinafter be called R and L addresses). Here, the R coefficient corresponds to the multiplication coefficient LAR1 or LAR2 of the multiplier in one of the data read/write units 82 and 83, the L coefficient corresponds to the multiplication coefficient LAL1 or LAL2 of the multiplier in one of the data read/write units 86 and 87, the R address corresponds to the offset value OFA1 or OFA2 of one of the data read/write units 82 and 83, and the L address corresponds to the offset value OFA3 or OFA4 of one of the data read/write units 86 and 87. In the following description, one of the two coefficients for use in the right-channel cross-fade interpolation will be called "C1" and the other will be called "C2". For example, C1 corresponds to LAL1 and C2 corresponds to LAL2. Likewise, C5 and C6 represent two coefficients for use in the left-channel cross-fade interpolation. For instance, C1 corresponds to LAL1 and C2 corresponds to LAL2.

Step 123: A determination is made as to whether the cross-fade operation has finished in the digital signal processor 1A (DSP) of FIG. 2. If the answer is YES, the flow goes to step 124 and other steps succeeding step 124 in order to perform an interpolation operation in correspondence to the movement of the operator. If the answer is NO meaning the interpolation by the digital signal processor is still in the process, the program waits for the current interpolation operation to finish. That is, because the operations in and after step 124 are directed to setting the movement target values into the units, the program does not perform the operations in and after step 124 but returns to the main routine as long as the interpolation operation is in progress.

The operations of steps 124 to 126 are directed to setting target values of sound image localization movement for the right channel.

Step 124: It is determined whether interpolation coefficient C1 of the data read/write unit 82 is "0", i.e., which of the data read/write units 82 and 83 is operative in the sound image localization control (i.e., which of the units 82 and 83 corresponds to the current values of sound image localization). If the interpolation operation has finished, the interpolation coefficient C1 of the data read/write unit 82 or interpolation coefficient C2 of the data read/write unit 83 has become "0", which means that the multiplication coefficient LAR1 or LAR2 of the data read/write units 82 or 83 is "0". This in turn means that one of the data read/write units 82 and 83 where the multiplication coefficient LAR1 or LAR2 is "0" is inoperative in the sound image localization control and the other unit corresponds to the current values of sound image localization. Accordingly, in the case where the interpolation coefficient C1 is "0", the first interpolating data read/write units 82 is inoperative, and hence the flow proceeds to step 125, where movement target value data are set into the first unit 82. On the other hand, in the case where the interpolation coefficient C1 is not "0", the interpolation coefficient C2 is "0" meaning that the second interpolating data read/write units 83 is inoperative, and hence the flow proceeds to step 126, where movement target value data are set into second unit 83.

Step 125: Because of the determination in the preceding step 124 that the interpolation coefficient C1 of the first interpolating data read/write unit 82 is "0" and the interpolation coefficient C2 of the second interpolating data read/write unit 83 is a predetermined value, the target R address is set into the offset value OFA1 of the first data read/write unit 82, the target R coefficient is set into the interpolation coefficient C1, and "0" is set as a target value into the interpolation coefficient C2 of the second unit 83. Thus, the coefficient C2 of the second unit 83 will be varied from the current value to the target value "0".

Because of the R address set as the offset value OFA1 of the data read/write unit 82 and the R coefficient set as the interpolation coefficient C1, the data read/write unit 82 has now been connected to the ring buffer 81 at such a position deviated from the right-channel reset index by the offset value OFA1 . Then, by virtue of the interpolation by the digital signal processor, the multiplication coefficient LAR1 of the data read/write unit 82 is interpolated to time-vary from the interpolation starting value of "0" to the target value corresponding to the R coefficient, and the multiplication coefficient LAR2 of the data read/write unit 83 is interpolated from a starting value (corresponding to the R coefficient, for example) to the target value of "0".

Step 126: Because of the determination in the preceding step 124 that the interpolation coefficient C1 of the data read/write unit 82 is a predetermined value and the interpolation coefficient C2 of the data read/write unit 83 is "0", the target R address is set into the offset value OFA2 of the second data read/write unit 83, and the R coefficient is set as an interpolation target value into the interpolation coefficient C2. Further, "0" is set as the interpolation coefficient C1 of the first unit 82.

Because of the R address set as the offset value OFA2 of the data read/write unit 83 and the R coefficient set as the interpolation coefficient C2, the data read/write unit 83 has now been connected to the ring buffer 81 at such a position deviated from the right-channel reset index by the offset value OFA2. Then, by virtue of the interpolation by the digital signal processor, the multiplication coefficient LAR2 of the data read/write unit 83 is interpolated from the interpolation starting value of "0" to the target R coefficient, and the multiplication coefficient LAR1 of the data read/write unit 82 is interpolated from a starting value (the R address, for instance) to the target value of "0".

The operations of steps 127 to 129 correspond to the above-mentioned steps 124 to 126 and are directed to setting target values of localization movement for the left channel.

Step 127: It is determined whether interpolation coefficient C5 of the data read/write unit 86 is "0", i.e., whether either of the data read/write units 86 and 87 is operative in the sound image localization control. If the interpolation operation has finished, either the interpolation coefficient C2 of the data read/write unit 86 or interpolation coefficient C6 of the data read/write unit 87 has become "0", which means that the multiplication coefficient LAL1 or LAL2 of the data read/write units 86 or 87 is "0". This in turn means that the data read/write units 86 or 87 where the multiplication coefficient LAL1 or LAL2 is "0" is inoperative in the sound image localization control. Accordingly, in the case where the interpolation coefficient C5 is "0" and hence the data read/write units 86 is inoperative, the flow proceeds to step 128. But, in the case where the interpolation coefficient C5 is not "0" but the interpolation coefficient C6 is "0", the data read/write units 87 is inoperative, and the flow proceeds to step 129.

Step 128: Because of the determination in the preceding step 127 that the interpolation coefficient C5 of the data read/write unit 86 is "0" and the interpolation coefficient C6 of the data read/write unit 87 is a predetermined value, the R address is set as the offset value OFA3 of the data read/write unit 86, the R coefficient is set as the interpolation coefficient C5, and "0" is set as the interpolation coefficient C6.

Because of the R address set as the offset value OFA3 of the data read/write unit 86 and the R coefficient set as the interpolation coefficient C5, the data read/write unit 86 has now been connected to the ring buffer 81 at such a position deviated from the left-channel reset index by the offset value OFA3 . Then, by virtue of the interpolation by the digital signal processor, the multiplication coefficient LAL1 of the data read/write unit 86 is interpolated to match the R coefficient, and the multiplication coefficient LAR2 of the data read/write unit 83 is interpolated to "0".

Step 129: Because of the determination in the preceding step 127 that the interpolation coefficient C5 of the data read/write unit 86 is a predetermined value and the interpolation coefficient C6 of the data read/write unit 87 is "0", the R address is set as the offset value OFA2 of the data read/write unit 87, "0" is set as the interpolation coefficient C5, and the R coefficient is set as the interpolation coefficient C6.

Because of the R address set as the offset value OFA2 of the data read/write unit 87 and the R coefficient set as the interpolation coefficient C6, the data read/write unit 87 has now been connected to the ring buffer 81 at such a position deviated from the right-channel reset index by the offset value OFA2. Then, by virtue of the interpolation by the digital signal processor, the multiplication coefficient LAL2 of the data read/write unit 87 is interpolated to match the R coefficient, and the multiplication coefficient LAR1 of the data read/write unit 86 is interpolated to "0".

In the case where the tone source circuit 19 is capable of generating tones in N channels, four data read/write units have to be reserved for each tone signal in order to allow separate or independent sound image localization control to be performed on each tone signal generated in one of the channels and in order to allow the cross-fade interpolation operation to be simultaneously performed for controlling the movement of sound image localization, as mentioned previously. In such a case, it is sufficient that the localization control circuit (DSP) 1A include N=4n data read/write operation units, and the tone generation channels of the tone source 19 and the group of the data read/write units (in other words, sound image localization channels) may be fixed in predetermined relationship to each other.

Figure 13:
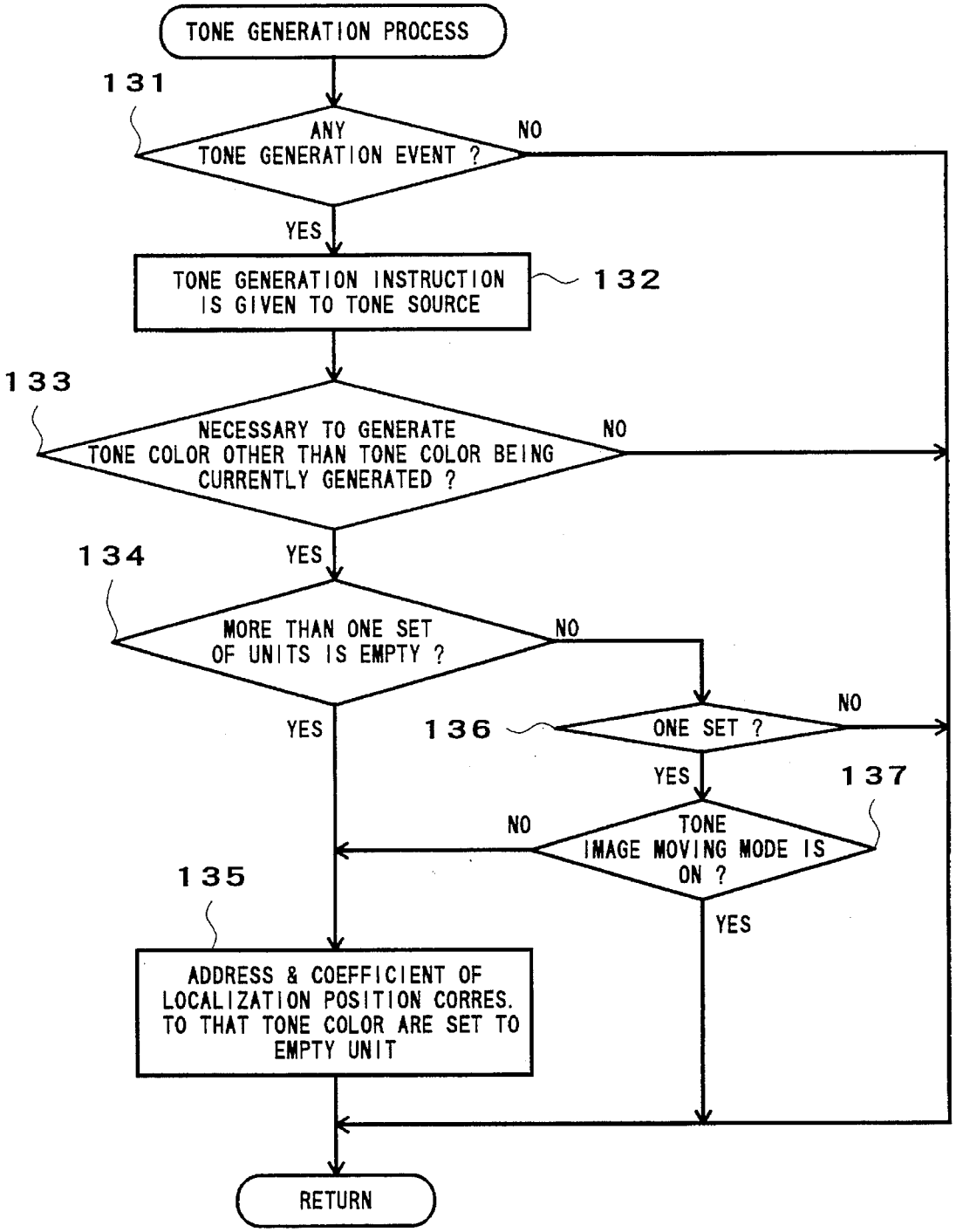
FIG. 13 is a flowchart showing an example of a tone generation process which allows a cross-fade interpolation operation function to be assigned in a sound image moving mode.

However, if, for example, automatic performance tone signals generated via an external sequencer or the like are received via MIDI wiring etc. and are input to the localization control circuit (DSP) 1A for sound image localization control under the control of the CPU 10, it is possible that the number of tone colors of the tone signals from the external sequencer (i.e., the number of tone signals to which different sound image localization control has to be applied) is more than the CPU 10 can deal with. In such a case, four data read/write operation units may be assigned only to the tone color (tone) for which movement of sound image localization is to be actually made, and only two data read/write operation unit may be assigned to the tone color (tone) for which no movement of sound image localization is to be made. This provides an efficient use of a limited number of data read/write operation units (N units). As an example approach to achieve such control, the CPU 10 may perform a tone generation process as shown in FIG. 13.

In the tone generation process, once a tone generation event (which corresponds to a key-on event or instruction to generate automatic performance tone at the time of key depression) is given substantially at predetermined tone generation timing, a tone corresponding to the tone generation event is generated in the tone source 19, and sound image localization control of the generated tone is efficiently assigned to specific data read/write operation units of the localization control circuit (DSP) 1A. Therefore, the tone generation process of FIG. 13 may be incorporated in substitution for steps 111, 112 and 113 in the keyboard process of FIG. 11.

The term "sound image localization channel" as used in the following description means an arithmetic operation channel for performing tone localization control of a single tone, but it never corresponds to the right and left channel in sound image localization. Namely, when timewise movement control of sound image localization is to be made (i.e., when a sound image moving mode is ON), two pairs of right and left data read/write units, i.e., a total of four "data read/write units" are required as arithmetic operation means for sound image localization control of a single tone, as previously mentioned. Therefore, in such a case, four "data read/write units" are used as one "sound image localization channel" for performing sound image localization control of a single tone. Further, as previously mentioned, if no timewise movement control of sound image localization is made, a pair of right and left "data read/write units", i.e., two "data read/write units" are sufficient as one "sound image localization channel" for performing sound image localization control of a single tone. The ON/OFF operation of the sound image moving mode may be performed either uniformly for all tones being generated or separately for each tone being generated. In the case where the ON/OFF operation of the sound image moving mode is performed uniformly for all tones being generated, if "n" is the maximum number of tones for which sound image localization is possible when the sound image moving mode is ON, "2n" will be the maximum number of tones for which sound image localization is possible when the sound image moving mode is OFF. On the other hand, in the case where the ON/OFF operation of the sound image moving mode is performed separately for each tone being generated, the maximum number of tones for which sound image localization is possible will vary from "n" to "2n" in a flexible manner.

Steps of FIG. 13 will be described below.

Step 131: A determination is made as to whether there has been any tone generation event. With an affirmative determination, the flow proceeds to next step 132; otherwise, the flow returns to the main routine to enter step 114 of FIG. 11. Therefore, this step 131 is the same as step 111 of FIG. 1 where an inquiry is made about the presence of a key depression event.

Step 132: A tone generation instruction is given to the tone source 19. Namely, a search is made for available tone generation channels, and tone color data of the tones are supplied to the tone source 19 in correspondence to the channels so as to generate tones corresponding to the tone generation event.

Step 133: A determination is made as to whether or not it is necessary to generate tone other than the currently generated tone. With the affirmative determination, the program proceeds to next step 134, but with the negative determination, the program immediately returns to the main routine to proceed to step 114 of FIG. 11. The term "tone color" as used herein is equivalent to the term "sound image localization control", and it is examined in this step whether there are already being generated tone having the same sound image localization as that of the tones associated with the tone generation event. If the examination result is YES, the program returns to the main routine since the same sound image localization channel (i.e., data read/write units) as these tones can be used. Namely, even in the case of different tone signal generated from the tone source 19, as long as the same sound image localization is applied, such tone signal may be added together so as to be input to the localization control circuit (DSP) 1A as a single tone signal. In contrast, in the case where the tone generation event is for different tone color from the currently generated tone, it is necessary to assign a sound image localization channel to the new tone color, and thus the program proceeds to step 134 to perform a sound image localization channel assignment operation. Conversely, in the case where the tone generation event is for same tone color as the currently generated tone, it is not necessary to assign sound image localization channel, and thus the program immediately returns to the main routine to proceed to step 114. The "assignment of sound image localization channel" means reserving four or two data read/write units.

Step 134: It is determined whether there are present more than one set of (i.e., four) empty units. If the answer is YES, the program further proceeds to step 135, but if not, the program branches to step 136. Here, the "empty unit" means a data read/write unit having multiplier where multiplication coefficient is set at "0", i.e., an available data read/write unit. If two empty units exist, this means that one set of available units exists, one unit for each of the right and left channels. Accordingly, if more than one set of such empty units is present, it is possible to perform the cross-fade interpolation operation in the right and left channels by use of four data read/write units.

Step 135: Because of the determination in the preceding step 134 that more than one set of the empty units is present, any one of the empty unit sets is reserved as long as the sound image moving mode is not ON, and then addresses (R and L addresses) and coefficients (R and L coefficients) of sound image localization positions corresponding to the tone color are set to assign the units as sound image localization channel. On the other hand, when the sound image moving mode is ON, two sets of the empty units are reserved and assigned as sound image localization channel for the cross-fade interpolation.

Step 136: Because of the determination in the preceding step 134 that there is present more than one set of the empty units, it is further determined in this step whether one set of the units is empty. If answered in the affirmative, the program proceeds to step 137; if there is no empty unit set at all, the program returns to the main routine to proceed to step 114 of FIG. 11.

Step 137: Because the previous steps 134 and 136 have determined that only one set of the units is empty, it is further determined in this step whether the current mode is a sound image moving mode. If the current mode is the sound image moving mode (YES), then the program returns to the main routine to proceed to step 114 of FIG. 11; if not, the program goes to step 135, where addresses (R and L addresses) and coefficients (R and L coefficients) of sound image localization positions corresponding to the tone color are set to that one set of the empty units.

That is, at least two sets of the empty units are required in the sound image moving mode as previously mentioned, and hence no sound image localization channel assignment is made in the case where only one set of the units is empty and the sound image moving mode is currently ON. On the other hand, in the case where only one set of the units is empty but the current mode is not the sound image moving mode, sound image localization channels are assigned to these units.

According to the embodiment of FIG. 13, the assignment of sound image localization channels is made depending on tone color to be used, without placing the DSP units in fixed correspondence to the individual tone colors. Thus, when it is likely that tone colors will be supplied more than the sound image localization channels, the assignment of sound image localization channels can be made only for the tone color being currently generated, so that a highly flexible system can be achieved.

Further, when no sound image movement is made, the sound image localization channels for the cross-fade function can be used as ordinary sound image localization channels, and this permits efficient use of the sound image localization channels.

Conversely, in the case where sound image movement is to be simultaneously effected for more than one tone color, the ordinary sound image localization channels may of course be used for the cross-fade function.

The embodiment of FIG. 13, when step 136 has determined that no empty unit set exits, or when step 137 has determined that the current mode is the sound image moving mode, the program immediately returns to the main routine without performing assignment of the sound image localization channels. However, this is only illustrative, and the assignment may be made to specific one of already assigned sound image localization channels which is closest in localization position address and coefficient, or may be made to such sound image localization channel which is for the same tone color as already assigned tone color.

According to the above-mentioned embodiments, if the sampling frequency is 50 kHz, the number of the delay coefficients can be made not greater than the product of 26 (stages)×2 irrespective of the number of channels for which the sound image localization is to be made. This can greatly save the capacity of delay memory.

Although the embodiments have been described in relation to the case where tones of three different tone colors are simultaneously generated in response to a single key depression operation, tone of only one tone color may be generated in response to a single key depression operation, provided that the electronic musical instrument has plural keyboards or the keyboard is divided into plural key areas. To such a case, the present invention can be advantageously applied since tones of three different tone colors will be simultaneously generated upon simultaneous operation of different keyboards or key areas. Further, the present invention can also be used in applications where automatic performance is made via an internal or external sequencer because tones of three different tone colors are simultaneously generated in such a case.

Further, while the embodiments have been described above in relation to the case where the real time sound image moving process is performed in response to the player's operation of predetermined operator, the sound image moving may also be executed mechanically in response to time-varying signal from a low-frequency oscillator or an envelope oscillator.

Furthermore, although the sound image moving device in accordance with the embodiments has been described in terms of two-dimensional sound image localization, a three-dimensional sound image localization device may of course be constructed by addition of FIR filter.

Moreover, although the sound image localization control device in accordance with the embodiments has been described as being contained in an electronic musical instrument, a separate sound image localization device may of course be constructed in such a manner that one or more sound signals are supplied from external sound source or sources and sound image localization control is applied to the supplied sound signal or signals.

With the present invention arranged in the above-mentioned manner, predetermined delay time can be imparted without compromising the effect of sound image localization even when separate delay circuit is not provided for each of plural sound sources.

What is claimed is:

1. A sound image localization control device for applying independent sound image localization control to each of plural input sound signals on the basis of at least individual amplitude coefficients and delay information for right and left channels that are separately provided for each of said input sound signals, said sound image localization control device comprising at least two processing systems corresponding to the right and left channels, common said sound signals being distributively input to each of said processing systems, each of said processing systems comprising:

a series of delay means providing plural delay stages;

coefficient operation means for arithmetically operating each of said input sound signals with said individual amplitude coefficient separately provided therefor; and input means for additively inputting said sound signals, having been arithmetically operated with said individual amplitude coefficients, to said delay means at respective said delay stages corresponding to said individual delay information, whereby said sound signals input to said respective delay stages are gradually mixed together while being sequentially delayed, so as to ultimately output a single sound signal that is a mixture of said plural sound signals arithmetically operated with said amplitude coefficients.

2. A sound image localization control device as defined in claim 1 which further comprises interpolation means for distributing said sound signal, having been arithmetically operated by said coefficient operation means, to at least two interpolation operation channels so as to multiply the distributed sound signals by respective predetermined interpolation coefficients, and for causing said sound signals multiplied by the predetermined interpolation coefficients to be additively input to different said delay stages of said delay means, whereby delay shorter than that provided by one said delay stage is achieved.

3. A sound image localization control device as defined in claim 2 wherein said predetermined interpolation coefficients are time-varied so as to achieve a smooth time-variation in the delay shorter than that provided by one said delay stage.

4. A sound image localization control device as defined in claim 1 wherein said coefficient operation means includes plural operation units each corresponding to one of said input sound signals, each of said operation units arithmetically operating the input sound signal corresponding thereto with said individual amplitude coefficient provided therefor, at least one of said operation units being comprised of an interpolation operation unit which distributes the corresponding input sound signal to at least two interpolation operation channels and multiplies the distributed sound signals by respective predetermined interpolation coefficients and said amplitude coefficient so as to output sound signals arithmetically operated with said amplitude coefficient and interpolation coefficients, and wherein said input means additively inputs one of said sound signals, output from said interpolation operation unit in correspondence to specific one of said input sound signals, to said delay means at specific one of said delay stages corresponding to said individual delay information for said specific sound signal, and said input means additively inputs other of said sound signals output from said interpolation means to said delay means at another said delay stage different from said specific delay stage.

5. A sound image localization control device as defined in claim 1 wherein said delay means includes data memory means for storing digital sound signal sample data, and read/write control means for controlling data write/read to and from said data memory means so as to allow the sound signal sample data, written at specific time at a specific address, to be read out from said specific address with a delay corresponding to a selected number of said delay stages so as to impart a time delay.

6. A sound image localization control device for applying independent sound image localization control to each of plural input sound signals on the basis of at least individual amplitude coefficients and delay information for right and left channels that are separately provided for each of said sound signals, said sound image localization control device comprising at least two processing systems corresponding to the right and left channels, common said sound signals being distributively input to each of said processing systems, each of said processing systems comprising:

storage means for storing plural sound signal sample data;

pointer means for generating pointer value to sequentially time-vary read or write address in said storage means;

plural operation units each corresponding to one of said plural input sound signals, each of said operation units including coefficient operation means for arithmetically operating the corresponding input sound signal with the individual amplitude coefficient separately provided therefor, and operation and control means for reading out the sample data from a specific address of said storage means in correspondence to a relative address corresponding to the individual delay information separately provided therefor, adding the sound signal, having been arithmetically operated by said coefficient operation means, to the read-out data, and writing a sum of said sound signal and read-out data into said specific address, said relative address sequentially varying in response to variation in the pointer value; and output means for reading out and outputting the sample data from a predetermined output address of said storage means, said output address sequentially varying in response to variation in the pointer value.

7. A sound image localization control device as defined in claim 6 wherein said storage means of said two processing systems are implemented by different storage areas in a common data memory.

8. A sound image localization control device as defined in claim 6 wherein said plural operation units of said two processing systems are implemented by a time-divisional processing method using a common digital signal processor.

9. A sound image localization control device as defined in claim 6 which further comprises means for assigning one of said input sound signals to specific one of said plural operation units, and wherein the one of said sound signals is supplied to the specific operation unit.

10. A sound image localization control device as defined in claim 6 which further comprises: means for assigning one of said input sound signals to specific two said operation units;

means for providing said specific two operation units with said amplitude coefficient, corresponding to said one input sound signal, in the form of coefficients interpolated in accordance with respective predetermined interpolation functions; and means for causing said operation and control means of said specific two operation units to access different addresses of said storage means, whereby delay time to be imparted to said one input sound signal is interpolated on the basis of said interpolated coefficients.

11. A sound image localization control device for applying sound image localization control to an input sound signal on the basis of at least amplitude coefficients and delay information for right and left channels, said sound image localization control device comprising:

at least two processing systems corresponding to the right and left channels, common said input sound signal being distributively input to each of said processing systems; and means for, in order to move sound image localization to be imparted to said input sound signal, providing first and second interpolation coefficients and first and second delay information for each of said processing systems in correspondence to said amplitude coefficients and delay information, wherein each of said processing systems comprises:

a series of delay means providing plural delay stages;

first and second operation units to which common said input sound signal is input, said first operation unit including first coefficient operation means for arithmetically operating the sound signal with said first coefficient and input means for additively inputting output sound signal of said first operation unit to said delay means at a specific first delay stage corresponding to said first delay information, said second operation unit including second coefficient operation means for arithmetically operating the corresponding sound signal with said second coefficient and input means for additively inputting output sound signal of said second operation unit to said delay means at a specific second delay stage corresponding to said second delay information, whereby the sound signals input at said delay stages are additively mixed while being sequentially delayed, so that a sound signal having been applied interpolation operation is output from said delay means.

12. A sound image localization control device as defined in claim 11 which comprises plural combinations of said first and second operation units, plural said input sound signals to be applied different sound image localization control being introduced into respective said combinations, whereby said sound signals input at said respective delay stages are gradually mixed while being sequentially delayed, so as to ultimately output a single sound signal which is a mixture of said plural sound signals having been applied the interpolation operation.

13. A sound image localization control device for applying independent sound image localization control to each of plural input sound signals on the basis of at least individual amplitude coefficients and delay information for right and left channels that are separately provided for each of said sound signals, said sound image localization control device comprising:

a first delay line for the right channel providing plural delay stages;

a second delay line for the left channel providing plural delay stages;

processing means including plural operation units each including coefficient operation means for arithmetically operating one of said input sound signals with said amplitude coefficient, and input means for accessing one of said delay lines and additively inputting output sound signal of said coefficient operation means to said one delay line at a specific delay stage corresponding to said delay information; and assignment means for, with respect to each of the input sound signals, assigning two of said operation units of said processing means as right and left channel operation units, respectively, said assignment means providing said amplitude coefficient and delay information for the right channel to said operation unit assigned as the right channel operation unit and causing said right channel operation unit to access said first delay line, and providing said amplitude coefficient and delay information for the left channel to said operation unit assigned as the left channel operation unit and causing said left channel operation unit to access said second delay line.

14. A sound image localization control device as defined in claim 13 wherein said assignment means additionally assigns two more said operation units as the right and left channel operation units, respectively, to said input sound signal, said assignment means providing two said operation units assigned as the right channel operation units with interpolation coefficients and delay information corresponding to said amplitude coefficient and delay information for the right channel and causing the right channel operation units to access said first delay line, said assignment means providing two said operation units assigned as the left channel operation units with interpolation coefficients and delay information corresponding to said amplitude coefficient and delay information for the left channel and causing the left channel operation units to access said second delay line.

15. A sound image localization control device as defined in claim 14 wherein said assignment means assigns said two more operation units to the input sound signal for which sound image localization is to be time-varied, said assignment means causing two said operation units assigned as the right channel operation units to access different said delay stages of said first delay line so as to allow respective interpolation coefficients to time-vary via a cross-fade interpolation method, said assignment means causing two said operation units assigned as the left channel operation units to access different said delay stages of said second delay line so as to allow respective interpolation coefficients to time-vary via a cross-fade interpolation method.

16. A sound image localization control device as defined in claim 13 which further comprises means for selecting a sound image moving mode, wherein said assignment means only assigns two said operation units of said processing means as the right and left operation units, respectively, when the sound image moving mode is not selected, but additionally assigns two more said operation units of said processing means as the right and left operation units, respectively, when the sound image moving mode is selected, and wherein when the sound image moving mode is selected, said assignment means providing said two operation units assigned as the right channel operation units with interpolation coefficients and delay information corresponding to said amplitude coefficient and delay information for the right channel and causing the right channel operation units to access said first delay line, said assignment means providing said two operation units assigned as the left channel operation units with interpolation coefficients and delay information corresponding to said amplitude coefficient and delay information for the left channel and causing the left channel operation units to access said second delay line.

17. A sound image localization control device as defined in claim 13 wherein said first and second delay lines include data memory means for storing digital sound signal sample data, and read/write control means for controlling data write/read to and from said data memory means so as to allow the sound signal sample data, written at specific time in a specific address, to be read out from said specific address with a delay corresponding to a selected number of the delay stages so as to impart a time delay.

* * * * *